US008754738B2

(12) United States Patent
Kato et al.

(10) Patent No.: US 8,754,738 B2
(45) Date of Patent: Jun. 17, 2014

(54) TRANSFORMER HAVING HIGH DEGREE OF COUPLING, ELECTRONIC CIRCUIT, AND ELECTRONIC DEVICE

(75) Inventors: Noboru Kato, Nagaokakyo (JP); Kenichi Ishizuka, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 13/546,007

(22) Filed: Jul. 11, 2012

(65) Prior Publication Data

US 2012/0274431 A1 Nov. 1, 2012

Related U.S. Application Data

(63) Continuation of application No. PCT/JP2011/050886, filed on Jan. 19, 2011.

(30) Foreign Application Priority Data

| | | |
|---|---|---|
| Jan. 19, 2010 | (JP) | 2010-009513 |
| Apr. 21, 2010 | (JP) | 2010-098312 |
| Apr. 21, 2010 | (JP) | 2010-098313 |
| Aug. 11, 2010 | (JP) | 2010-180088 |
| Sep. 17, 2010 | (JP) | 2010-209295 |
| Jan. 19, 2011 | (JP) | 2011-008535 |

(51) Int. Cl.
*H01F 5/00* (2006.01)
*H01F 27/28* (2006.01)
*H01F 27/30* (2006.01)

(52) U.S. Cl.
USPC ..... 336/200; 336/182; 336/205; 29/602.1

(58) Field of Classification Search
CPC . H01F 27/2804; H01F 17/0013; H01F 19/04; H01F 2027/2819; H03H 2001/0085; H03H 7/21; H03H 7/38; H03H 7/425; H05K 1/165; H05K 1/0298; H02M 3/336; H02M 7/043
USPC ..... 336/182, 199, 200, 205, 220, 222; 29/602.1
See application file for complete search history.

(56) References Cited

U.S. PATENT DOCUMENTS

| | | | | |
|---|---|---|---|---|
| 6,414,475 | B1 * | 7/2002 | Dames et al. | 324/127 |
| 6,781,229 | B1 * | 8/2004 | Fazelpour | 257/700 |

(Continued)

FOREIGN PATENT DOCUMENTS

| | | | |
|---|---|---|---|
| JP | 07-306903 | A | 11/1995 |
| JP | 10-294218 | A | 11/1998 |

(Continued)

OTHER PUBLICATIONS

Official Communication issued in International Patent Application No. PCT/JP2011/050886, mailed on May 10, 2011.

(Continued)

*Primary Examiner* — Alexander Talpalatski
*Assistant Examiner* — Joselito Baisa
(74) *Attorney, Agent, or Firm* — Keating & Bennett, LLP

(57) ABSTRACT

A transformer having a high degree of coupling is connected between, for example, an antenna element and a power feed circuit. The transformer having a high degree of coupling includes a first inductance element connected to the power feed circuit and a second inductance element coupled to the first inductance element. A first end of the first inductance element is connected to the power feed circuit and a second end of the first inductance element is connected to the antenna element. A first end of the second inductance element is connected to the antenna element and a second end of the second inductance element is grounded.

7 Claims, 23 Drawing Sheets

(56) References Cited

U.S. PATENT DOCUMENTS

| | | | | |
|---|---|---|---|---|
| 7,106,162 | B2 * | 9/2006 | Saito | 336/229 |
| 7,796,007 | B2 * | 9/2010 | Hopper et al. | 336/200 |
| 7,969,270 | B2 * | 6/2011 | Berke et al. | 336/182 |
| 7,978,041 | B2 * | 7/2011 | Bertilsson | 336/200 |
| 2004/0012474 | A1 * | 1/2004 | Hwu et al. | 336/200 |
| 2008/0266042 | A1 * | 10/2008 | Yoshimura et al. | 336/181 |

FOREIGN PATENT DOCUMENTS

| | | | |
|---|---|---|---|
| JP | 2000-244273 | A | 9/2000 |
| JP | 2002-203721 | A | 7/2002 |
| JP | 2004-304615 | A | 10/2004 |
| JP | 2005-323132 | A | 11/2005 |
| JP | 2009-246624 | A | 10/2009 |
| WO | 2009/020025 | A1 | 2/2009 |

OTHER PUBLICATIONS

Kato et al., "Antenna Device and Communication Terminal Apparatus", U.S. Appl. No. 13/218,501, filed Aug. 26, 2011.

Ishizuka et al., "Frequency Stabilization Circuit, Antenna Device, and Communication Terminal Device", U.S. Appl. No. 13/369,364, filed Feb. 9, 2012.

* cited by examiner

TRANSFORMER HAVING HIGH DEGREE OF COUPLING, ELECTRONIC CIRCUIT, AND ELECTRONIC DEVICE

BACKGROUND OF THE INVENTION

1. Field of the Invention

The present invention relates to a transformer having a high degree of coupling in which inductance elements are coupled to each other with a high degree of coupling and an electronic circuit and an electronic device that include the transformer having a high degree of coupling.

2. Description of the Related Art

Transformers generally include primary coils and secondary coils that are magnetically coupled to each other via magnetic paths. The transformers are widely used in various electronic circuits and electronic devices, such as voltage step-up and step-down circuits, transformers having a high degree of coupling, current transformation and shunt circuits, balance-unbalance conversion circuits, and signal transmission circuits.

In order to reduce the loss in transmission energy in the transformers, it is necessary to increase the degree of coupling between the primary coils and the secondary coils. For this purpose, methods of winding the primary coils and the secondary coils around ferrite magnetic bodies commonly used for the primary coils and the secondary coils have been adopted, for example, as described in Japanese Unexamined Patent Application Publication No. 10-294218 and Japanese Unexamined Patent Application Publication No. 2002-203721.

However, since lead wires are wound around the ferrite magnetic bodies to form the coils in the transformers disclosed in Japanese Unexamined Patent Application Publication No. 10-294218 and Japanese Unexamined Patent Application Publication No. 2002-203721, the manufacturing processes are complicated and the transformers are increased in size.

SUMMARY OF THE INVENTION

In view of the above-described problems, preferred embodiments of the present invention provide a transformer having a high degree of coupling that is easy to manufacture, that is easy to be reduced in size, and that is capable of transmitting energy with significantly lower loss.

A transformer having a high degree of coupling according to a preferred embodiment of the present invention includes a first inductance element and a second inductance element coupled to the first inductance element with a high degree of coupling. The first inductance element is coupled to the second inductance element via a magnetic field and an electric field. When alternating current flows through the first inductance element, the direction of current flowing through the second inductance element due to the coupling via the magnetic field coincides with the direction of current flowing through the second inductance element due to the coupling via the electric field.

When alternating current flows through the first inductance element, the direction of current flowing through the second inductance element is preferably the direction along which a magnetic barrier occurs between the first inductance element and the second inductance element.

The first inductance element preferably includes a first coil element and a second coil element and the first coil element is preferably connected in series to the second coil element and winding patterns of conductors of the first coil element and the second coil element are preferably arranged to define a closed magnetic circuit.

Preferably, the second inductance element includes a third coil element and a fourth coil element and the third coil element is connected in series to the fourth coil element and winding patterns of conductors of the third coil element and the fourth coil element are arranged to define a closed magnetic circuit.

The first inductance element preferably includes a first coil element and a second coil element and the first coil element is preferably connected in series to the second coil element and winding patterns of conductors of the first coil element and the second coil element are preferably arranged to define a closed magnetic circuit. It is also preferable that the second inductance element includes a third coil element and a fourth coil element and that the third coil element is connected in series to the fourth coil element and winding patterns of conductors of the third coil element and the fourth coil element are arranged to define a closed magnetic circuit. It is also preferable that the first coil element and the third coil element be arranged such that an opening of the first coil element opposes an opening of the third coil element, and that the second coil element and the fourth coil element be arranged such that an opening of the second coil element opposes an opening of the fourth coil element.

The first inductance element and the second inductance element preferably include conductor patterns arranged in a multilayer body in which a plurality of dielectric or magnetic layers is laminated, and the first inductance element is preferably coupled to the second inductance element in the multilayer body.

An electronic circuit according to a preferred embodiment of the present invention includes a transformer having a high degree of coupling including a first inductance element and a second inductance element coupled to the first inductance element with a high degree of coupling, wherein the first inductance element is coupled to the second inductance element via a magnetic field and an electric field, and wherein, when alternating current flows through the first inductance element, the direction of current flowing through the second inductance element due to the coupling via the magnetic field coincides with the direction of current flowing through the second inductance element due to the coupling via the electric field; a primary side circuit connected to the first inductance element; and a secondary side circuit connected to the second inductance element.

An electronic device according to a preferred embodiment of the present invention includes a transformer having a high degree of coupling including a first inductance element and a second inductance element coupled to the first inductance element with a high degree of coupling, wherein the first inductance element is coupled to the second inductance element via a magnetic field and an electric field, and wherein, when alternating current flows through the first inductance element, the direction of current flowing through the second inductance element due to the coupling via the magnetic field coincides with the direction of current flowing through the second inductance element due to the coupling via the electric field; a primary side circuit connected to the first inductance element; a secondary side circuit connected to the second inductance element; and a circuit that transfers a signal or power between the primary side circuit and the secondary side circuit via the transformer having a high degree of coupling.

According to the transformer having a high degree of coupling of a preferred embodiment of the present invention, the primary side circuit connected to the first inductance element can be coupled to the secondary side circuit connected to the second inductance element with a high degree of coupling, for example, with a degree of coupling k being equal to about 1.2 or higher, which is not normally achieved. Accordingly, it is possible to reduce the transformer in size and, furthermore, to reduce the size of the electronic circuit and the electronic device including the transformer.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
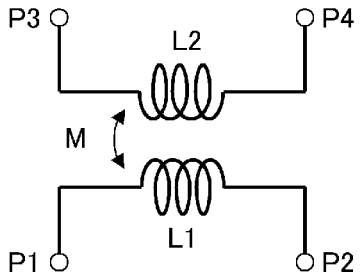
FIG. 1 is a circuit diagram of a transformer having a high degree of coupling of a first preferred embodiment of the present invention.

FIG. 1 is a circuit diagram of a transformer having a high degree of coupling of a first preferred embodiment.

As shown in FIG. 1, the transformer having a high degree of coupling includes a first inductance element L1 and a second inductance element L2 coupled to the first inductance element L1 with a high degree of coupling. A first end of the first inductance element L1 is preferably used as a first port P1 and a second end thereof is preferably used as a second port P2. A first end of the second inductance element L2 is preferably used as a third port P3 and a second end thereof is preferably used as a fourth port P4.

The first inductance element L1 is tightly coupled to the second inductance element L2.

Figure 2A:
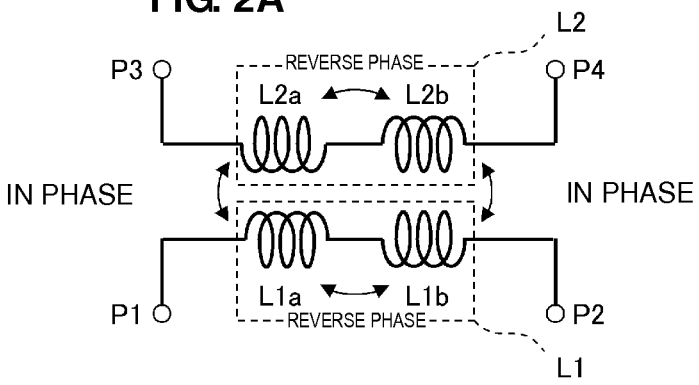
FIG. 2A is a more specific circuit diagram of the transformer having a high degree of coupling shown in FIG. 1 and FIG. 2B specifically shows the arrangement of coil elements in the transformer having a high degree of coupling.
Figure 2B:
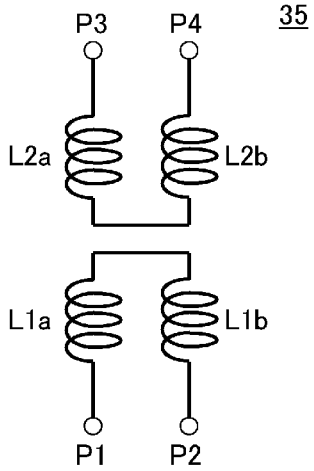

FIG. 2A is a more specific circuit diagram of the transformer having a high degree of coupling shown in FIG. 1 and FIG. 2B specifically shows the arrangement of coil elements in the transformer having a high degree of coupling.

In a transformer having a high degree of coupling 35 shown in FIG. 2A, the first inductance element L1 includes a first coil element L1*a* and a second coil element L1*b*. The first coil element L1*a* and the second coil element L1*b* are connected in series to each other and are wound so as to define a closed magnetic circuit. The second inductance element L2 includes a third coil element L2*a* and a fourth coil element L2*b*. The third coil element L2*a* and the fourth coil element L2*b* are connected in series to each other and are wound so as to define a closed magnetic circuit. In other words, the first coil element L1*a* is coupled to the second coil element L1*b* in reverse phase (additive polarity coupling) and the third coil element L2*a* is coupled to the fourth coil element L2*b* in reverse phase (the additive polarity coupling).

In addition, the first coil element L1*a* is preferably coupled to the third coil element L2*a* in phase (subtractive polarity coupling) and the second coil element L1*b* is preferably coupled to the fourth coil element L2*b* in phase (the subtractive polarity coupling).

Second Preferred Embodiment

Figure 3:
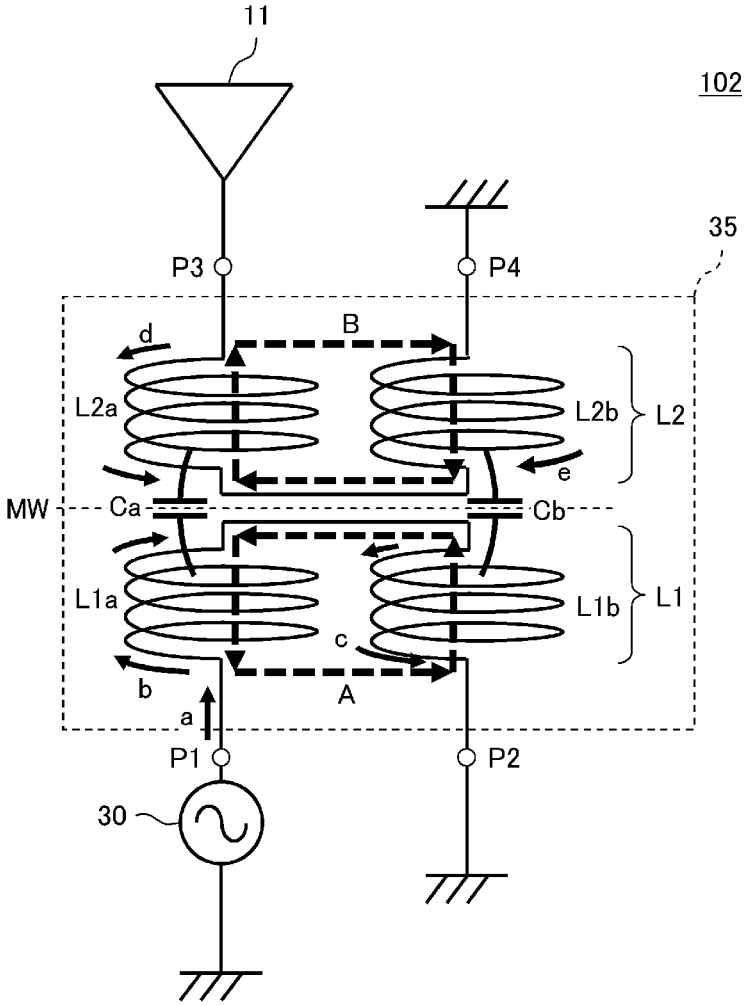
FIG. 3 is a circuit diagram of an antenna apparatus 102 in which the transformer having a high degree of coupling 35 shown in the first preferred embodiment is applied as a transformer having a high degree of coupling for the antenna.

FIG. 3 is a circuit diagram of an antenna apparatus 102 in which the transformer having a high degree of coupling 35 shown in the first preferred embodiment is applied as a transformer having a high degree of coupling for the antenna.

As shown in FIG. 3, the antenna apparatus 102 includes an antenna element 11 and the transformer having a high degree of coupling 35 connected to the antenna element 11. The antenna element 11 preferably is a monopole antenna, and the transformer having a high degree of coupling 35 is connected to a power feed end of the antenna element 11. The transformer having a high degree of coupling 35 is provided between the antenna element 11 and a power feed circuit 30. The power feed circuit 30 supplies a radio-frequency signal to the antenna element 11. The power feed circuit 30 performs generation and processing of the radio-frequency signal. The power feed circuit 30 may include circuits that multiplex and demultiplex the radio-frequency signal.

As shown in FIG. 3, when current is supplied from the power feed circuit 30 in a direction shown by an arrow a, the current flows through the first coil element L1*a* in a direction shown by an arrow b and the current flows through the second coil element L1*b* in a direction shown by an arrow c. The currents form a magnetic flux passing through the closed magnetic circuit, as shown by an arrow A in FIG. 3.

Since the coil element L1*a* is lined with the coil element L2*a*, a magnetic field caused by the current b flowing through the coil element L1*a* is coupled to the coil element L2*a* to cause an induced current d to flow through the coil element L2*a* in a direction opposite to the direction of the current b. Similarly, since the coil element L1*b* is lined with the coil element L2*b*, a magnetic field caused by the current c flowing through the coil element L1*b* is coupled to the coil element L2*b* to cause an induced current e to flow through the coil element L2*b* in a direction opposite to the direction of the current c. The currents form a magnetic flux passing through the closed magnetic circuit, as shown by an arrow B in FIG. 3.

Since the closed magnetic circuit of the magnetic flux A occurring in the first inductance element L1 including the coil elements L1*a* and L1*b* is independent of the closed magnetic circuit of the magnetic flux B occurring in the second inductance element L2 including the coil elements L2*a* and L2*b*, an equivalent magnetic barrier MW occurs between the first inductance element L1 and the second inductance element L2.

The coil element L1*a* is coupled to the coil element L2*a* also via an electric field. Similarly, the coil element L1*b* is coupled to the coil element L2*b* also via an electric field. Accordingly, when alternating current flows through the coil element L1*a* and the coil element L1*b*, the current is excited in the coil element L2*a* and the coil element L2*b* by the electric field coupling. Capacitors Ca and Cb in FIG. 3 symbolically denote the coupling capacitances for the electric field coupling.

When the alternating current flows through the first inductance element L1, the direction of the current flowing through the second inductance element L2 due to the coupling via the magnetic field coincides with the direction of the current flowing through the second inductance element L2 due to the coupling via the electric field. Accordingly, the first inductance element L1 and the second inductance element L2 are tightly coupled to each other via both the magnetic field and the electric field. In other words, it is possible to propagate the radio-frequency energy with significantly reduced loss.

The transformer having a high degree of coupling 35 may also be referred to as a circuit configured such that, when the alternating current flows through the first inductance element L1, the direction of the current flowing through the second inductance element L2 due to the coupling via the magnetic field coincides with the direction of the current flowing through the second inductance element L2 due to the coupling via the electric field.

Figure 4:
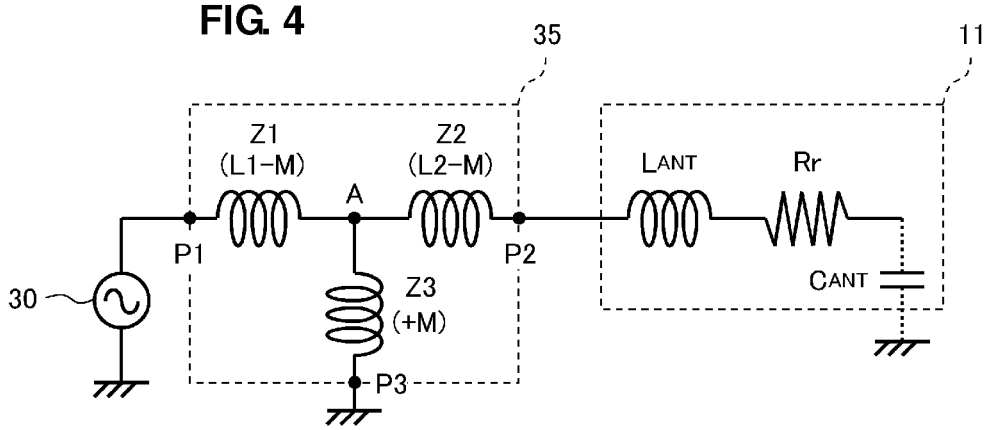
FIG. 4 is an equivalent circuit diagram of the antenna apparatus 102.

FIG. 4 is an equivalent circuit diagram of the antenna apparatus 102. As shown in FIG. 4, the antenna apparatus 102 equivalently includes an inductance component $L^{ANT}$, a radiation resistance component Rr, and a capacitance component $C^{ANT}$. The inductance component $L^{ANT}$ of the antenna element 11 behaves so as to be offset by a negative added inductance (L2−M) in the transformer having a high degree of coupling 35. In other words, the inductance component (of the antenna element 11 including the second inductance element Z2) when the antenna element 11 side is viewed from an A point in the transformer having a high degree of coupling is small (ideally, is equal to zero) and, thus, impedance frequency characteristics of the antenna apparatus 102 are decreased.

In order to cause the negative inductance component, it is important to couple the first inductance element to the second inductance element with a high degree of coupling. Specifically, the degree of coupling should be higher than or equal to one.

An impedance conversion ratio in the transformer type circuit is indicated by the ratio (L1:L2) between the inductance L1 of the first inductance element L1 and the inductance L2 of the second inductance element L2.

Figure 5:
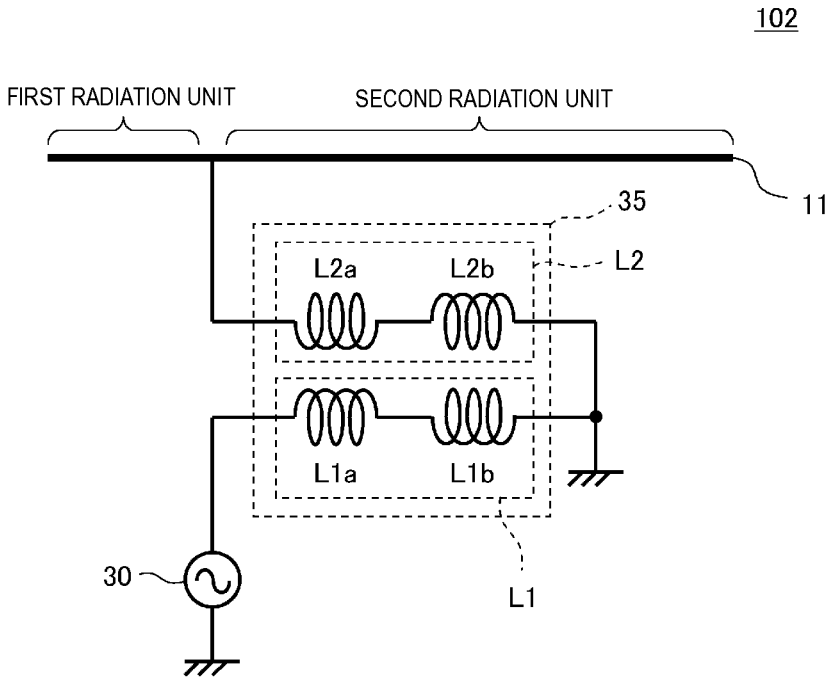
FIG. 5 is a circuit diagram of the antenna apparatus 102 supporting multiband operation.

FIG. 5 is a circuit diagram of the antenna apparatus 102 supporting multiband operation. The antenna apparatus 102 is preferably for use in a multiband-supporting mobile radio communication system (an 800-MHz band, a 900-MHz band, a 1,800-MHz band, and a 1,900-MHz band) supporting a Global System for Mobile Communications (GSM) mode and a Code Division Multiple Access (CDMA) mode, for example. The antenna element 11 preferably is a branched monopole antenna.

Third Preferred Embodiment

Figure 6A:
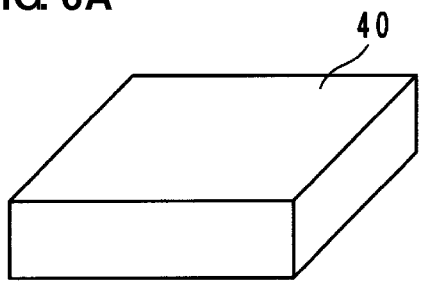
FIG. 6A is a perspective view of the transformer having a high degree of coupling 35 of a third preferred embodiment of the present invention and FIG. 6B is a perspective view viewed from the bottom surface side of the transformer having a high degree of coupling 35.
Figure 6B:
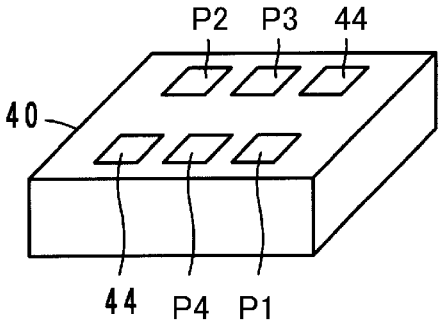
Figure 7:
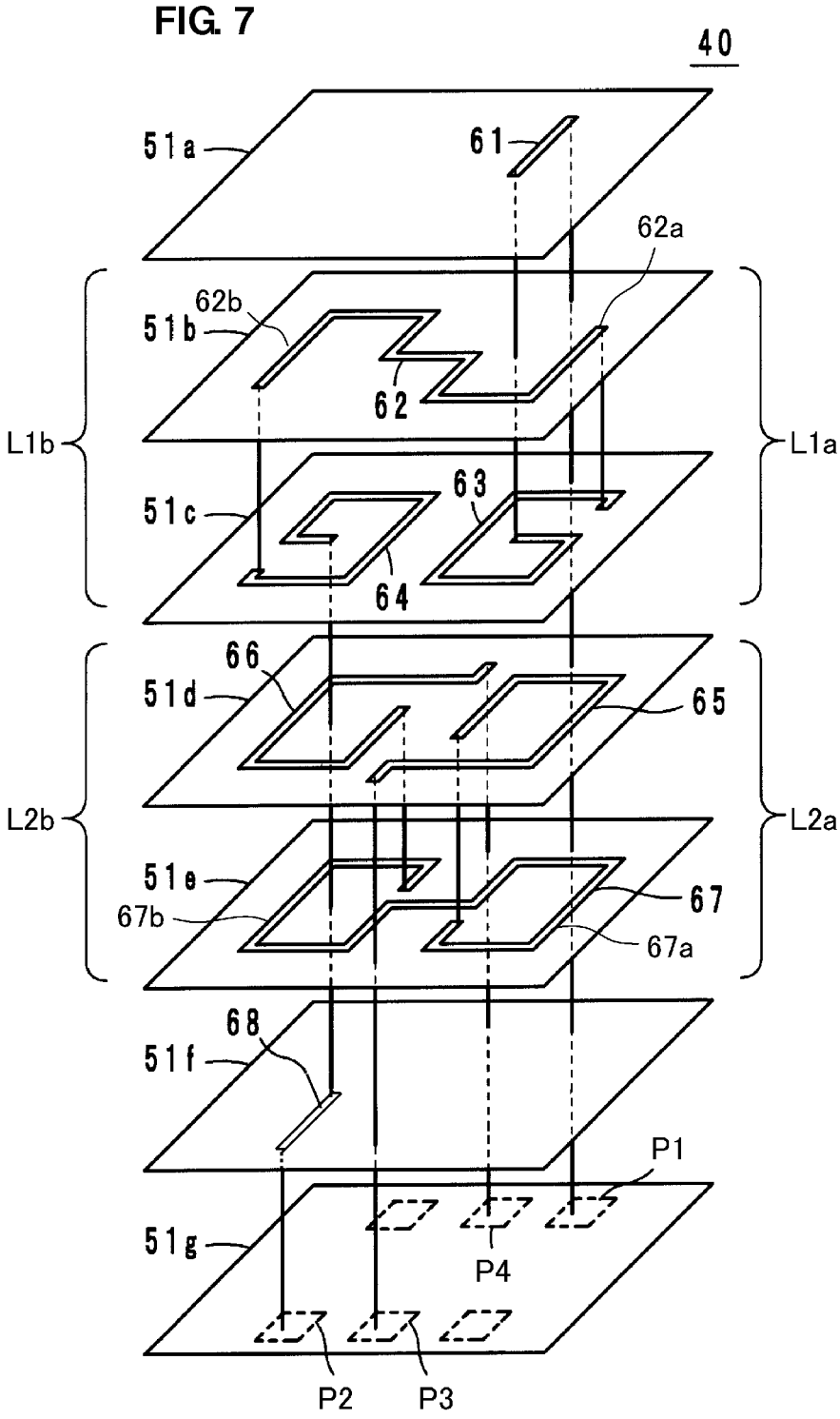
FIG. 7 is an exploded perspective view of a multilayer body 40 of the transformer having a high degree of coupling 35.

FIG. 6A is a perspective view of the transformer having a high degree of coupling 35 of a third preferred embodiment. FIG. 6B is a perspective view viewed from the bottom face side of the transformer having a high degree of coupling 35. FIG. 7 is an exploded perspective view of a multilayer body 40 defining the transformer having a high degree of coupling 35.

As shown in FIG. 7, a conductor pattern 61 is provided on a top base layer 51*a* of the multilayer body 40, a conductor pattern 62 (62*a* and 62*b*) is provided on a second base layer 51*b* thereof, conductor patterns 63 and 64 are provided on a third base layer 51*c* thereof. Conductor patterns 65 and 66 are provided on a fourth base layer 51*d* of the multilayer body 40 and a conductor pattern 67 (67*a* and 67*b*) is provided on a fifth base layer 51*e* thereof. In addition, a conductor pattern 68 is provided on a sixth base layer 51*f* of the multilayer body 40 and the ports P1, P2, P3, and P4 (that are connection terminals and that are hereinafter simply referred to as the ports) are provided on the rear surface of a seventh base layer 51*g* thereof. A plain base layer (not shown) is laminated on the top base layer 51*a*.

The conductor patterns 62*a* and 63 define the first coil element L1*a* and the conductor patterns 62*b* and 64 define the second coil element L1*b*. The conductor patterns 65 and 67*a* define the third coil element L2*a* and the conductor patterns 66 and 67*b* define the fourth coil element L2*b*.

The various conductor patterns 61 to 68 may be made of a material containing a conductive material, such as silver or copper, as the major component, for example. The base layers 51*a* to 51*g* may be made of, for example, a glass ceramic material or an epoxy based resin material, when the base layers 51*a* to 51*g* are formed of dielectric bodies, or may be made of, for example, a ferrite ceramic material or a resin material containing ferrite, when the base layers 51*a* to 51*g* are formed of magnetic bodies. In particular, a dielectric material is preferably used as the material of the base layers in order to form the transformer having a high degree of coupling for an Ultra High-Frequency (UHF) band and a magnetic material is preferably used as the material of the base layers in order to form the transformer having a high degree of coupling for a High-Frequency (HF) band.

Laminating the base layers 51*a* to 51*g* causes the conductor patterns 61 to 68 and the ports P1, P2, P3, and P4 to be connected to each other via inter-layer connection conductors (via conductors) to define the circuit shown in FIG. 3.

As shown in FIG. 7, the first coil element L1*a* is arranged adjacent to the second coil element L1*b* such that the winding axis of the coil pattern of the first coil element L1*a* is parallel or substantially parallel to that of the coil pattern of the second coil element L1*b*. Similarly, the third coil element L2*a* is arranged adjacent to the fourth coil element L2*b* such that the winding axis of the coil pattern of the third coil element L2*a* is parallel or substantially parallel to that of the coil pattern of the fourth coil element L2*b*. In addition, the first coil element L1*a* is arranged adjacent to the third coil element L2*a* such that the winding axis of the coil pattern of the first coil element L1*a* is aligned or substantially aligned with that of the coil pattern of the third coil element L2*a* (coaxial relationship). Similarly, the second coil element L1*b* is arranged adjacent to the fourth coil element L2*b* such that the winding axis of the coil pattern of the second coil element L1*b* is aligned or substantially aligned with that of the coil pattern of the fourth coil element L2*b* (coaxial relationship). Furthermore, the first to fourth coil elements L1*a*, L1*b*, L2*a*, and L2*b* are arranged such that an opening of the first coil element L1*a* opposes an opening of the third coil element L2*a* and an opening of the second coil element L1*b* opposes an opening of the fourth coil element L2*b*. In other words, the conductor patterns of the respective coil patterns are arranged so as to be overlaid with each other, viewed from the lamination direction of the base layers.

Although each of the coil elements L1*a*, L1*b*, L2*a*, and L2*b* preferably includes a substantially two-turn loop conductor, the number of turns is not limited to this. It is not necessary for the winding axes of the coil patterns of the first coil element L1*a* and the third coil element L2*a* to be strictly aligned with each other and it is sufficient for the first coil element L1*a* and the third coil element L2*a* to be wound such that the opening of the first coil element L1*a* coincides with that of the third coil element L2*a* in a planar view. Similarly, it is not necessary for the winding axes of the coil patterns of the second coil element L1*b* and the fourth coil element L2*b* to be strictly aligned with each other and it is sufficient for the second coil element L1*b* and the fourth coil element L2*b* to be wound such that the opening of the second coil element L1*b* coincides with that of the fourth coil element L2*b* in a planar view.

Incorporating the respective coil elements L1*a*, L1*b*, L2*a*, and L2*b* in the dielectric or magnetic multilayer body 40 in the above manner, in particular, providing an area where the first inductance element L1 including the coil elements L1*a* and L2*b* is coupled to the second inductance element L2 including the coil elements L2*a* and L2*b* in the multilayer body 40 causes the element values of the elements of the transformer having a high degree of coupling 35 and the degree of coupling between the first inductance element L1 and the second inductance element L2 to be less affected by other electronic devices arranged adjacent to the multilayer body 40. As a result, it is possible to further stabilize the frequency characteristics.

Figure 8:
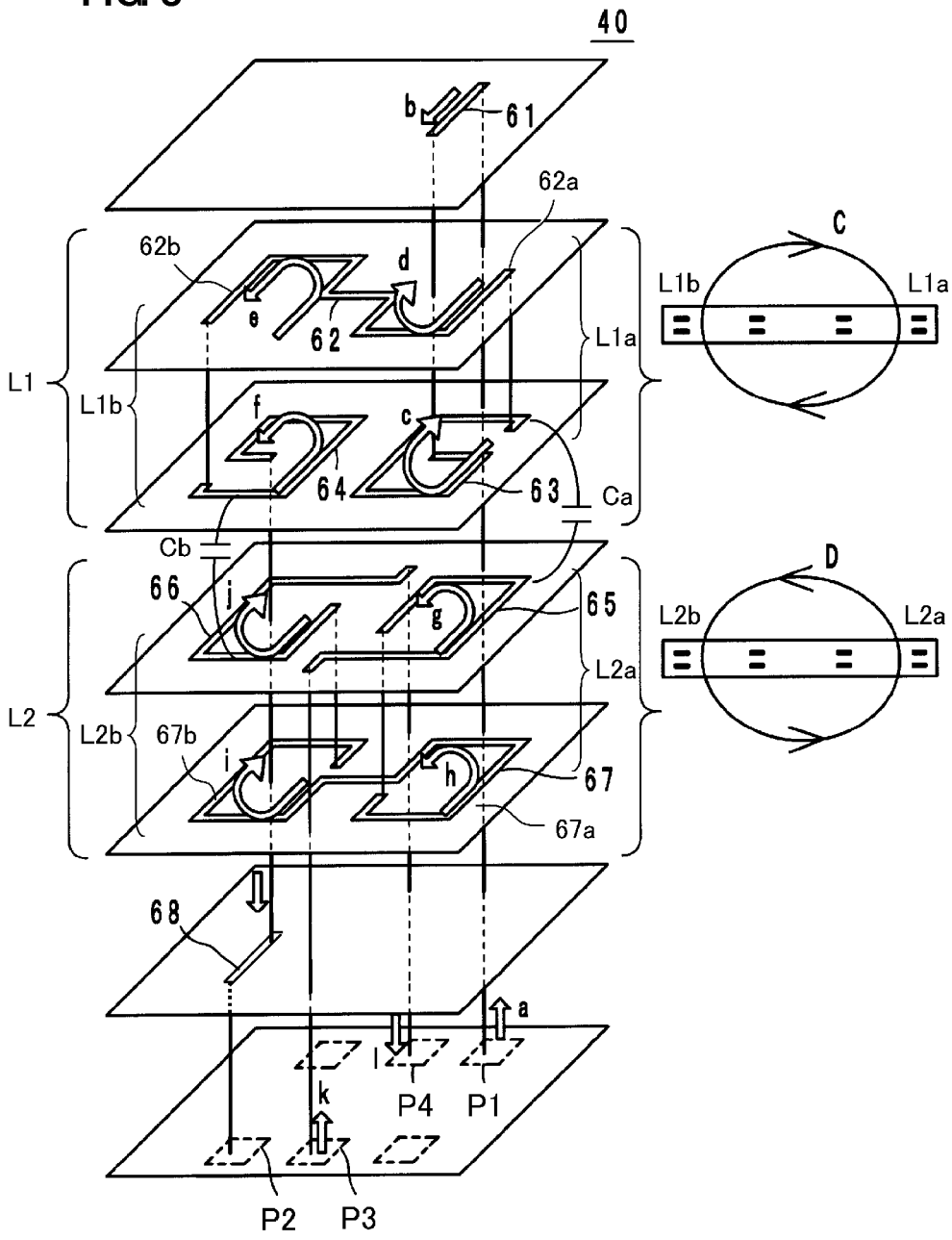
FIG. 8 shows the principle of the operation of the transformer having a high degree of coupling 35.

FIG. 8 shows the principle of the operation of the transformer having a high degree of coupling 35. As shown in FIG. 8, when a high-frequency signal current input through the port P1 flows in a manner shown by arrows a and b, the current is applied to the first coil element L1*a* (the conductor patterns 62*a* and 63) in a manner shown by arrows c and d and is applied to the second coil element L1*b* (the conductor patterns 62*b* and 64) in a manner shown by arrows e and f. Since the first coil element L1*a* (the conductor patterns 62*a* and 63) is lined with the third coil element L2*a* (the conductor patterns 65 and 67*a*), a high-frequency signal current shown by arrows g and h is induced in the third coil element L2*a* (the conductor patterns 65 and 67*a*) by the inductive coupling and the electric field coupling between the first coil element L1*a* and the third coil element L2*a*.

Similarly, since the second coil element L1*b* (the conductor pattern 62*b* and 64) is lined with the fourth coil element L2*b* (the conductor patterns 66 and 67*b*), a high-frequency signal current shown by arrows i and j is induced in the fourth coil element L2*b* (the conductor patterns 66 and 67*b*) by the inductive coupling and the electric field coupling between the second coil element L1*b* and the fourth coil element L2*b*.

As a result, a high-frequency signal current shown by an arrow k flows through the port P3 and a high-frequency signal current shown by an arrow 1 flows through the port P4. When the current (the arrow a) flowing through the port P1 is directed to an opposite direction, the direction of the other currents is made opposite.

Since the conductor pattern 63 of the first coil element L1*a* opposes the conductor pattern 65 of the third coil element L2*a*, the electric field coupling occurs between the conductor pattern 63 and the conductor pattern 65 and the current caused by the electric field coupling flows in the same direction as that of the induced current. In other words, the degree of coupling is increased by the magnetic field coupling and the electric field coupling. Similarly, the magnetic field coupling and the electric field coupling occur between the conductor pattern 64 of the second coil element L1*b* and the conductor pattern 66 of the fourth coil element L2*b*.

The first coil element L1*a* is coupled to the second coil element L1*b* in phase to define the closed magnetic circuit and the third coil element L2*a* is coupled to the fourth coil element L2*b* in phase to define the closed magnetic circuit. Accordingly, two magnetic fluxes C and D are generated to reduce the losses in energy between the first coil element L1*a* and the second coil element L1*b* and between the third coil element L2*a* and the fourth coil element L2*b*. Setting the inductance value of the first coil element L1*a* and that of the second coil element L1*b* to substantially the same element value and setting the inductance value of the third coil element L2*a* and that of the fourth coil element L2*b* to substantially the same element value reduce the leakage field of the closed magnetic circuits to further reduce the loss in energy. The element values of the coil elements may be appropriately designed to control the impedance conversion ratio.

Since the third coil element L2*a* is electrically coupled to the fourth coil element L2*b* with capacitors Cag and Cbg via the ground conductor 68, the current caused by the electric field coupling increases the degree of coupling between L2*a* and L2*b*. If the multilayer body 40 is grounded at the upper side, it is possible to cause the electric field coupling between the first coil element L1*a* and the second coil element L1*b* with the capacitors Cag and Cbg to further increase the degree of coupling between L1*a* and L1*b*.

The magnetic flux C excited by a primary current flowing through the first inductance element L1 and the magnetic flux D excited by a secondary current flowing through the second inductance element L2 occur so as to defeat (repel) each other because of the induced current. As a result, since the magnetic field occurring in the first coil element L1*a* and the second coil element L1*b* and the magnetic flux occurring in the third coil element L2*a* and the fourth coil element L2*b* are contained in narrow spaces, the first coil element L1*a* is coupled to the third coil element L2*a* with higher degree of coupling and the second coil element L1*b* is coupled to the fourth coil element L2*b* with higher degree of coupling. In other words, the first inductance element L1 is coupled to the second inductance element L2 with a high degree of coupling.

Fourth Preferred Embodiment

Figure 9:
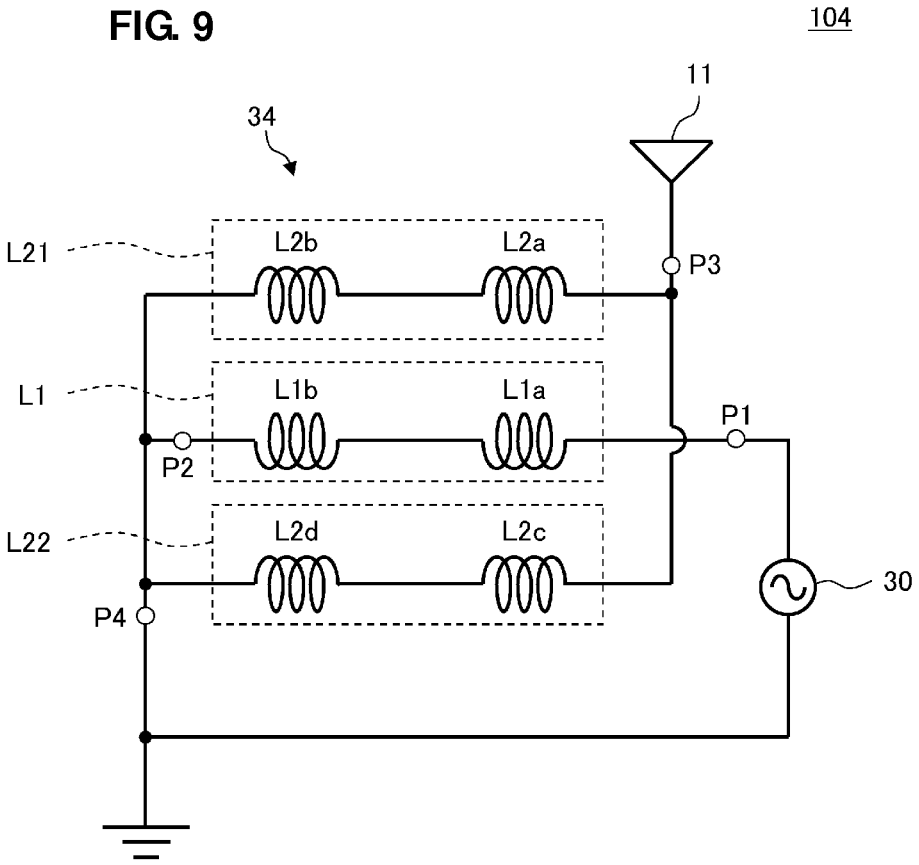
FIG. 9 is a circuit diagram of a transformer having a high degree of coupling 34 of a fourth preferred embodiment of the present invention and an antenna apparatus 104 including the transformer having a high degree of coupling 34.

FIG. 9 is a circuit diagram of a transformer having a high degree of coupling 34 of a fourth preferred embodiment and an antenna apparatus 104 including the transformer having a high degree of coupling 34. The transformer having a high degree of coupling 34 included in the fourth preferred embodiment includes the first inductance element L1 and two second inductance elements L21 and L22. A fifth coil element L2*c* and a sixth coil element L2*d* of the second inductance element L22 are coupled to each other in phase. The fifth coil element L2*c* is coupled to the coil element L1*a* in reverse phase, and the sixth coil element L2*d* is coupled to the coil element L1*b* in reverse phase. One end of the fifth coil element L2*c* is connected to the radiation element 11 and one end of the sixth coil element L2*d* is grounded.

Figure 10:
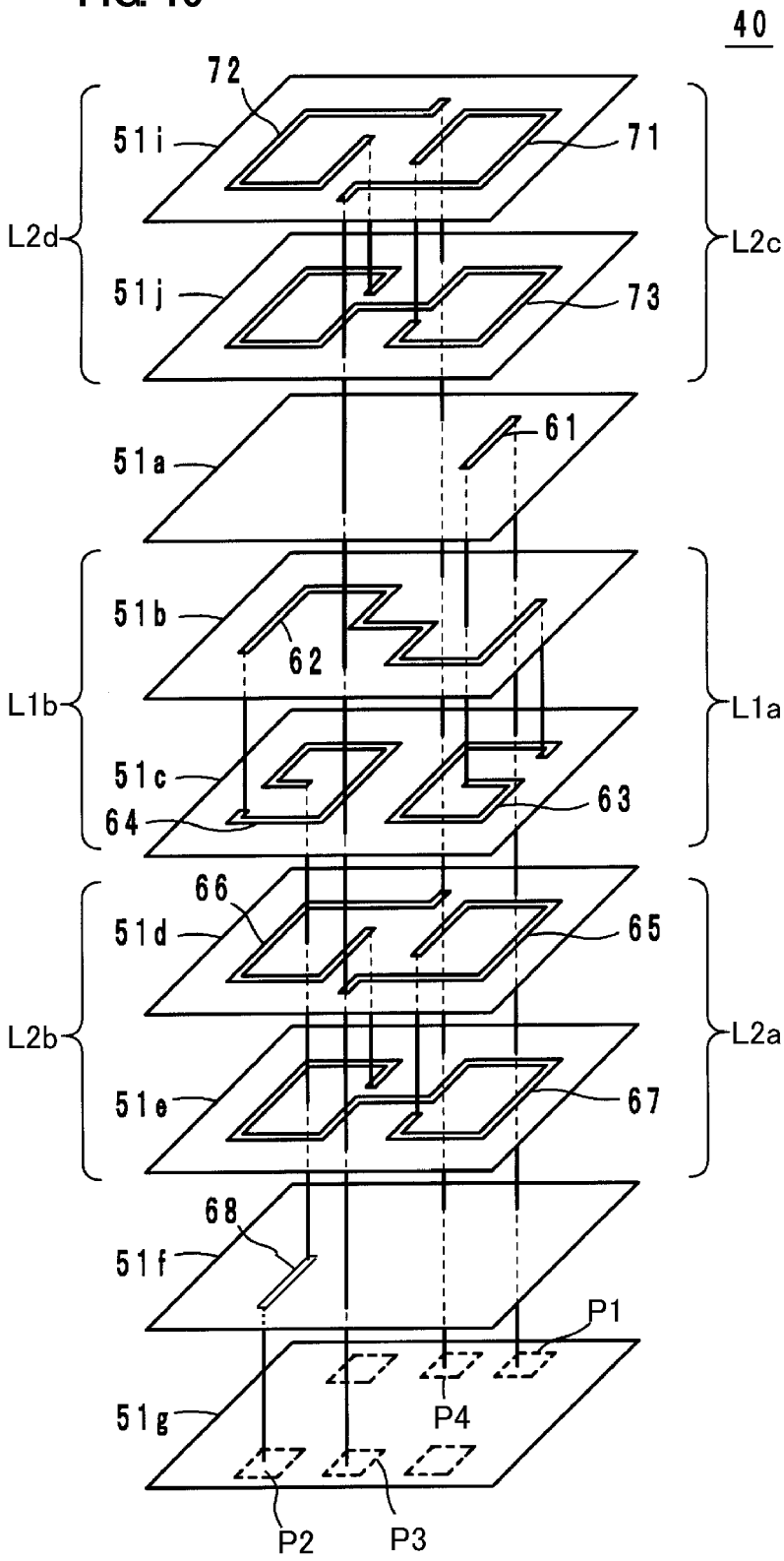
FIG. 10 is an exploded perspective view of a multilayer body 40 of the transformer having a high degree of coupling 34.

FIG. 10 is an exploded perspective view of the multilayer body 40 of the transformer having a high degree of coupling 34. In this example, base layers 51*i* and 51*j* on which conductors 71, 72, and 73 of the fifth coil element L2*c* and the sixth coil element L2*d* are provided are laminated on the multilayer body 40 of the third preferred embodiment shown in FIG. 7. Specifically, the fifth and sixth coil elements are configured preferably in the same manner as in the first to fourth coil elements described above, the fifth and sixth coil elements L2*c* and L2*d* are including the conductors of coil patterns, and the fifth and sixth coil elements L2*c* and L2*d* are wound so that the magnetic flux occurring in the fifth and sixth coil elements L2*c* and L2*d* defines the closed magnetic circuit.

The principle of the operation of the transformer having a high degree of coupling 34 of the fourth preferred embodiment is basically the same as that in the first to third preferred embodiments described above. In the fourth preferred embodiment, the first inductance element L1 is arranged so as to be sandwiched between the second inductance elements L21 and L22 to significantly reduce and prevent a stray capacitance occurring between the first inductance element L1 and the ground. The significant reduction and prevention of such a capacitance component that does not contribute to the radiation allows the radiation efficiency of the antenna to be improved.

In addition, since the first inductance element L1 is more tightly coupled to the second inductance elements L21 and L22, that is, the leakage field is reduced, the energy transmission loss of the radio-frequency signals between the first inductance element L1 and the second inductance elements L21 and L22 is reduced.

Fifth Preferred Embodiment

Figure 11A:
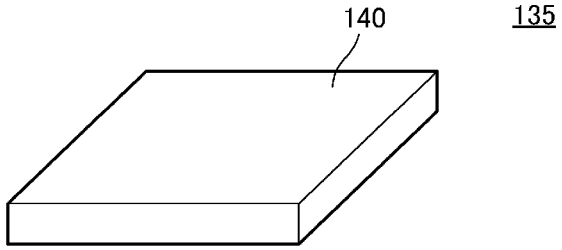
FIG. 11A is a perspective view of a transformer having a high degree of coupling 135 of a fifth preferred embodiment of the present invention and FIG. 11B is a perspective view of the transformer having a high degree of coupling 135, viewed from the bottom side thereof.
Figure 11B:
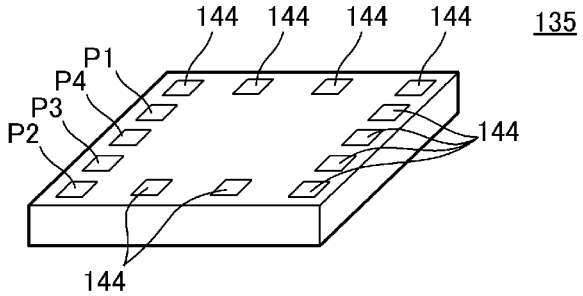
Figure 12:
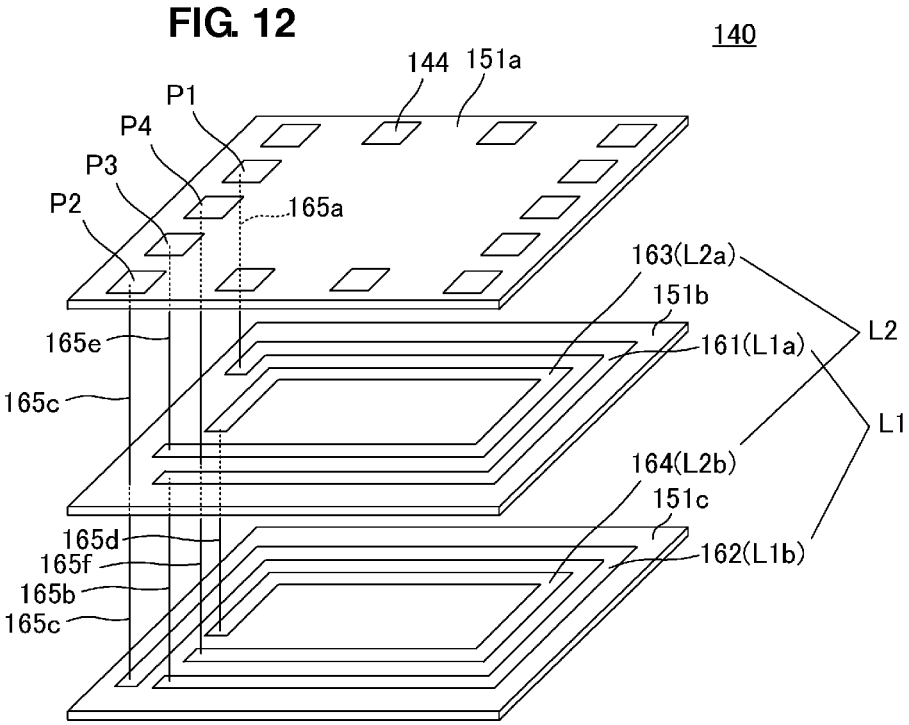
FIG. 12 is an exploded perspective view of a multilayer body 140 of the transformer having a high degree of coupling 135.

FIG. 11A is a perspective view of a transformer having a high degree of coupling 135 of a fifth preferred embodiment. FIG. 11B is a perspective view of the transformer having a high degree of coupling 135, viewed from the bottom side thereof. FIG. 12 is an exploded perspective view of a multilayer body 140 of the transformer having a high degree of coupling 135.

The multilayer body 140 includes multiple base layers laminated therein, which are preferably formed of dielectric bodies or magnetic bodies. The port P1 connected to the power feed circuit 30, the ports P2 and P4 that are grounded, and the port P3 connected to the antenna element 11 are provided on the rear surface of the multilayer body 140. A Normally Closed (NC) terminal used for mounting is also provided on the rear surface of the multilayer body 140. An inductor and/or a capacitor for impedance matching may be installed on the front surface of the multilayer body 140, if necessary. The inductor and/or the capacitor defined by an electrode pattern may be provided in the multilayer body 140.

In the transformer having a high degree of coupling 135 incorporated in the multilayer body 140, as illustrated in FIG. 12, the ports P1, P2, P3, and P4 are provided on a first base layer 151*a*, conductor patterns 161 and 163 defining the first and third coil elements L1*a* and L2*a* are provided on a second base layer 151*b*, and conductor patterns 162 and 164 defining the second and fourth coil elements L1*b* and L2*b* are provided on a third base layer 151*c*.

The conductor patterns 161 to 164 may be formed by, for example, screen printing of paste containing a conductive material, such as silver or copper, as the major component or etching on metal foils. The base layers 151*a* to 151*c* may be made of, for example, a glass ceramic material or an epoxy based resin material, when the base layers 151*a* to 151*c* are formed of dielectric bodies, or may be made of, for example, a ferrite ceramic material or a resin material containing ferrite, when the base layers 151*a* to 151*c* are formed of magnetic bodies.

Laminating the base layers 151*a* to 151*c* cause the conductor patterns 161 to 164 and the ports P1, P2, P3, and P4 to be connected to each other via inter-layer connection conductors (via hole conductors) to define the equivalent circuit shown in FIG. 2A. Specifically, the port P1 is connected to one end of the conductor pattern 161 (the first coil element L1*a*) via a via hole conductor 165*a*, and the other end of the conductor pattern 161 is connected to one end of the conductor pattern 162 (the second coil element L1*b*) via a via-hole conductor 165*b*. The other end of the conductor pattern 162 is connected to the port P2 via a via-hole conductor 165*c*, one end of the conductor pattern 164 (the fourth coil element L2*b*) is connected to one end of the conductor pattern 163 (the third coil element L2*a*) via a via-hole conductor 165*d*, and the other end of the conductor pattern 164 (the fourth coil element L2*b*) is connected to the port P4 via a via-hole conductor 165*f*. The other end of the conductor pattern 163 is connected to the port P3 via a via-hole conductor 165*e*.

Incorporating the respective coil elements L1*a*, L1*b*, L2*a*, and L2*b* in the dielectric or magnetic multilayer body 140 in the above manner, in particular, providing an area where the first inductance element L1 is coupled to the second inductance element L2 in the multilayer body 140 causes the transformer having a high degree of coupling 135 to be less affected by other circuits or devices arranged adjacent to the multilayer body 140. As a result, it is possible to further stabilize the frequency characteristics.

Providing the first coil element L1*a* and the third coil element L2*a* on the same layer (the base layer 151*b*) in the multilayer body 140 and providing the second coil element L1*b* and the fourth coil element L2*b* on the same layer (the base layer 151*c*) in the multilayer body 140 reduce the multilayer body 140 (the transformer having a high degree of coupling 135) in thickness. In addition, since it is possible to form the first coil element L1*a* and the third coil element L2*a* coupled to each other in the same process (for example, application of conductive paste) and to form the second coil element L1*b* and the fourth coil element L2*b* coupled to each other in the same process (for example, application of conductive paste), the variation in the degree of coupling caused by, for example, lamination shift is significantly reduced and prevented to improve the reliability.

Sixth Preferred Embodiment

Figure 13A:
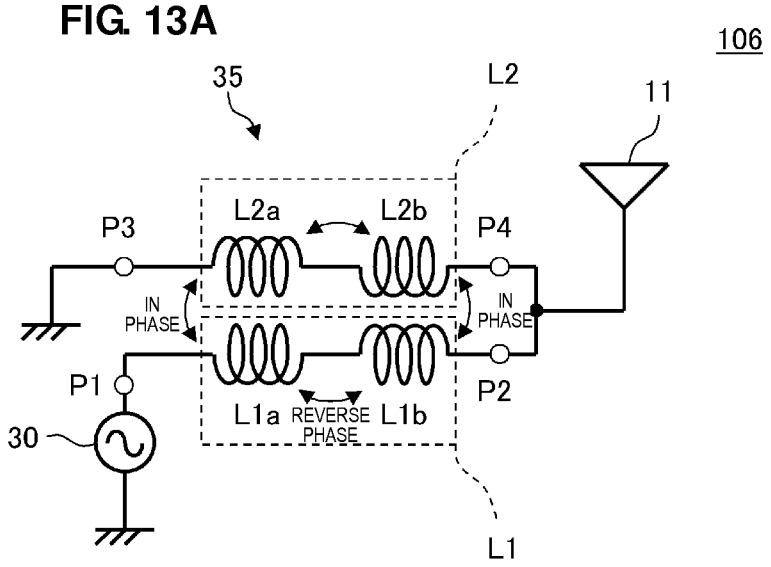
FIG. 13A is a circuit diagram of an antenna apparatus 106 of a sixth preferred embodiment of the present invention and FIG. 13B specifically shows the arrangement of coil elements in the antenna apparatus 106.
Figure 13B:
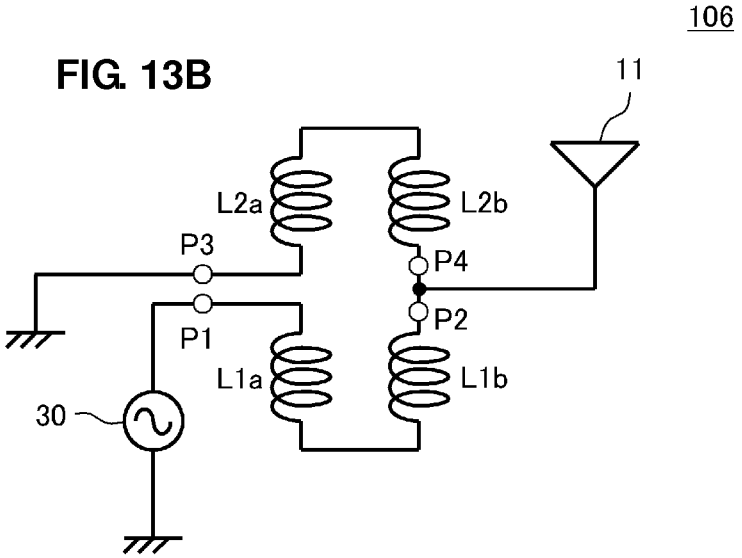

FIG. 13A is a circuit diagram of an antenna apparatus 106 of a sixth preferred embodiment and FIG. 13B specifically shows the arrangement of coil elements in the antenna apparatus 106.

Although the configuration of the transformer having a high degree of coupling provided in the antenna apparatus 106 of the sixth preferred embodiment is preferably the same as that in the first preferred embodiment, the transformer having a high degree of coupling of the sixth preferred embodiment differs from that of the first preferred embodiment in a manner of how the transformer having a high degree of coupling is connected to the respective ports. The example in the sixth preferred embodiment shows a connection structure that achieves a pseudo large negative inductance in the transformer having a high degree of coupling 35.

As illustrated in FIG. 13A, the first inductance element L1 includes the first coil element L1*a* and the second coil element L1*b*. The first coil element L1*a* and the second coil element L1*b* are connected in series to each other and are wound so as to define a closed magnetic circuit. The second inductance element L2 includes the third coil element L2*a* and the fourth coil element L2*b*. The third coil element L2*a* and the fourth coil element L2*b* are connected in series to each other and are wound so as to define a closed magnetic circuit. In other words, the first coil element L1*a* is coupled to the second coil element L1*b* in reverse phase (additive polarity coupling) and the third coil element L2*a* is coupled to the fourth coil element L2*b* in reverse phase (the additive polarity coupling).

In addition, the first coil element L1*a* is preferably coupled to the third coil element L2*a* in phase (subtractive polarity coupling) and the second coil element L1*b* is preferably coupled to the fourth coil element L2*b* in phase (the subtractive polarity coupling).

Figure 14A:
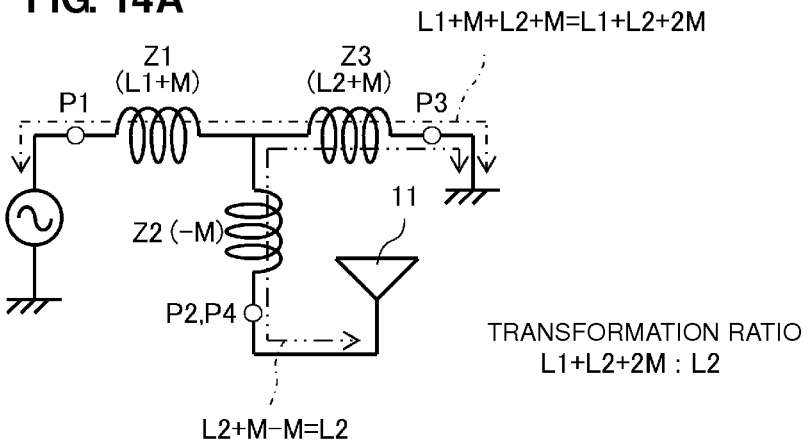
FIG. 14A shows a transformation ratio of the transformer having a high degree of coupling 35 and negative inductance components connected to the antenna element on the basis of the equivalent circuit shown in FIG. 13B.
Figure 14B:
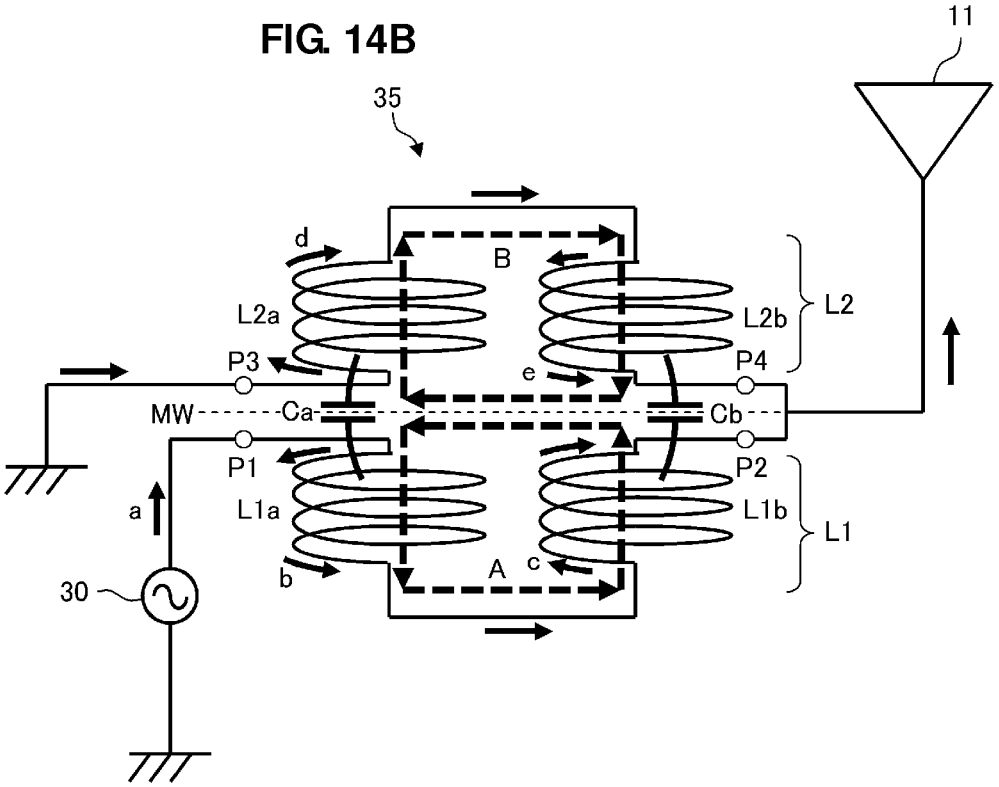
FIG. 14B is a diagram in which various arrows indicating how the magnetic field coupling and the electric field coupling are performed are added to the circuit in FIG. 13B.

FIG. 14A shows a transformation ratio of the transformer having a high degree of coupling 35 and negative inductance components connected to the antenna on the basis of the equivalent circuit shown in FIG. 13B. FIG. 14B is a diagram in which various arrows indicating how the magnetic field coupling and the electric field coupling are performed are added to the circuit in FIG. 13B.

As shown in FIG. 14A, the transformer having a high degree of coupling is a transformer-type circuit in which the first inductance element L1 is tightly coupled to the second inductance element L2 via a mutual inductance M. The transformer-type circuit is capable of being equivalently converted into a T-shaped circuit including three inductance elements Z1, Z2, and Z3. Among the inductance elements Z1, Z2, and Z3, the inductance element Z2 is connected to the antenna element 11 to offset the positive inductance component of the antenna element 11 with the pseudo negative inductance (−M) of the inductance element Z2.

As shown in FIG. 14B, when current is supplied from the power feed circuit in a direction shown by an arrow a, the current flows through the first coil element L1*a* in a direction shown by an arrow b and the current flows through the coil element L1*b* in a direction shown by an arrow c. The currents define a magnetic flux (a magnetic flux passing through the closed magnetic circuit) shown by an arrow A in FIG. 14B.

Since the coil element L1*a* is lined with the coil element L2*a*, a magnetic field caused by the current b flowing through the coil element L1*a* is coupled to the coil element L2*a* to cause an induced current d to flow through the coil element L2*a* in a direction opposite to the direction of the current b. Similarly, since the coil element L1*b* is lined with the coil element L2*b*, a magnetic field caused by the current c flowing through the coil element L1*b* is coupled to the coil element L2*b* to cause an induced current e to flow through the coil element L2*b* in a direction opposite to the direction of the current c. The currents define a magnetic flux passing through the closed magnetic circuit, as shown by an arrow B in FIG. 14B.

Since the closed magnetic circuit of the magnetic flux A occurring in the first inductance element L1 including the coil elements L1*a* and L1*b* is independent of the closed magnetic circuit of the magnetic flux B occurring in the second inductance element L2 including the coil elements L1*b* and L2*b*, the equivalent magnetic barrier MW occurs between the first inductance element L1 and the second inductance element L2.

The coil element L1*a* is coupled to the coil element L2*a* also via the electric field. Similarly, the coil element L1*b* is coupled to the coil element L2*b* also via the electric field. Accordingly, when alternating current flows through the coil element L1*a* and the coil element L1*b*, the current is excited in the coil element L2*a* and the coil element L2*b* by the electric field coupling. Capacitors Ca and Cb in FIG. 14B symbolically denote the coupling capacitances for the electric field coupling.

When the alternating current flows through the first inductance element L1, the direction of the current flowing through the second inductance element L2 due to the coupling via the magnetic field coincides with the direction of the current flowing through the second inductance element L2 due to the coupling via the electric field. Accordingly, the first inductance element L1 and the second inductance element L2 are tightly coupled to each other via both the magnetic field and the electric field. In other words, it is possible to propagate the radio-frequency energy with a significantly reduced loss.

The transformer having a high degree of coupling 35 may also be referred to as a circuit configured such that, when the alternating current flows through the first inductance element L1, the direction of the current flowing through the second inductance element L2 due to the coupling via the magnetic field coincides with the direction of the current flowing through the second inductance element L2 due to the coupling via the electric field.

Equivalent conversion of the transformer having a high degree of coupling 35 results in the circuit shown in FIG. 14A. Specifically, the added inductance between the power feed circuit and the ground is equal to L1+M+L2+M=L1+L2+2M, as shown by an alternate long and short dash line in FIG. 14A. The added inductance between the antenna element and the ground is equal to L2+M−M=L2, as shown by a double dotted chain line in FIG. 14A. In other words, the transformation ratio in the transformer having a high degree of coupling is equal to L1+L2+2M:L2, so that it is possible to configure the transformer having a high degree of coupling with high transformation ratio.

Figure 15:
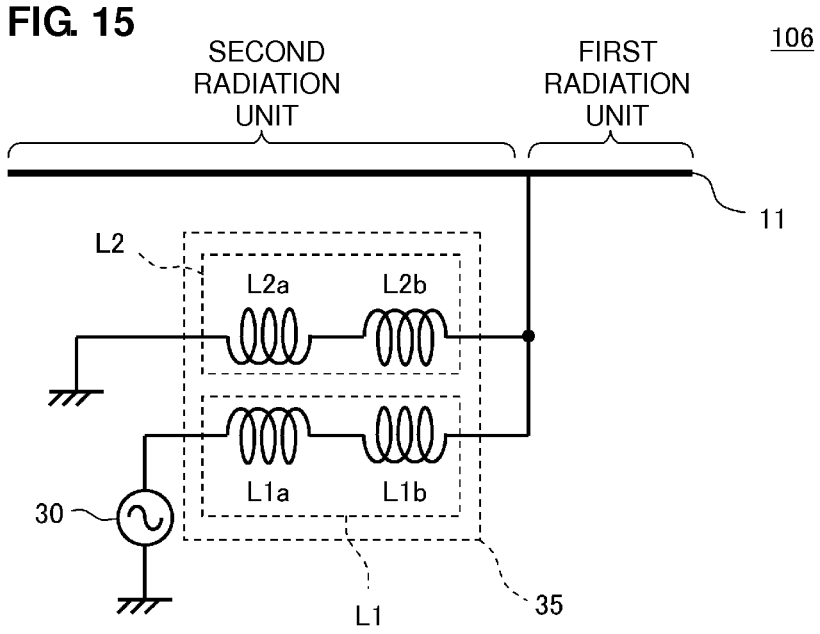
FIG. 15 is a circuit diagram of the antenna apparatus 106 supporting multiband operation.

FIG. 15 is a circuit diagram of the antenna apparatus 106 supporting multiband operation. The antenna apparatus 106 is preferably for use in a multiband-supporting mobile radio communication system (the 800-MHz band, the 900-MHz band, the 1,800-MHz band, and the 1,900-MHz band) supporting the GSM mode and the CDMA mode, for example. The antenna element 11 preferably is a branched monopole antenna.

Seventh Preferred Embodiment

Figure 16:
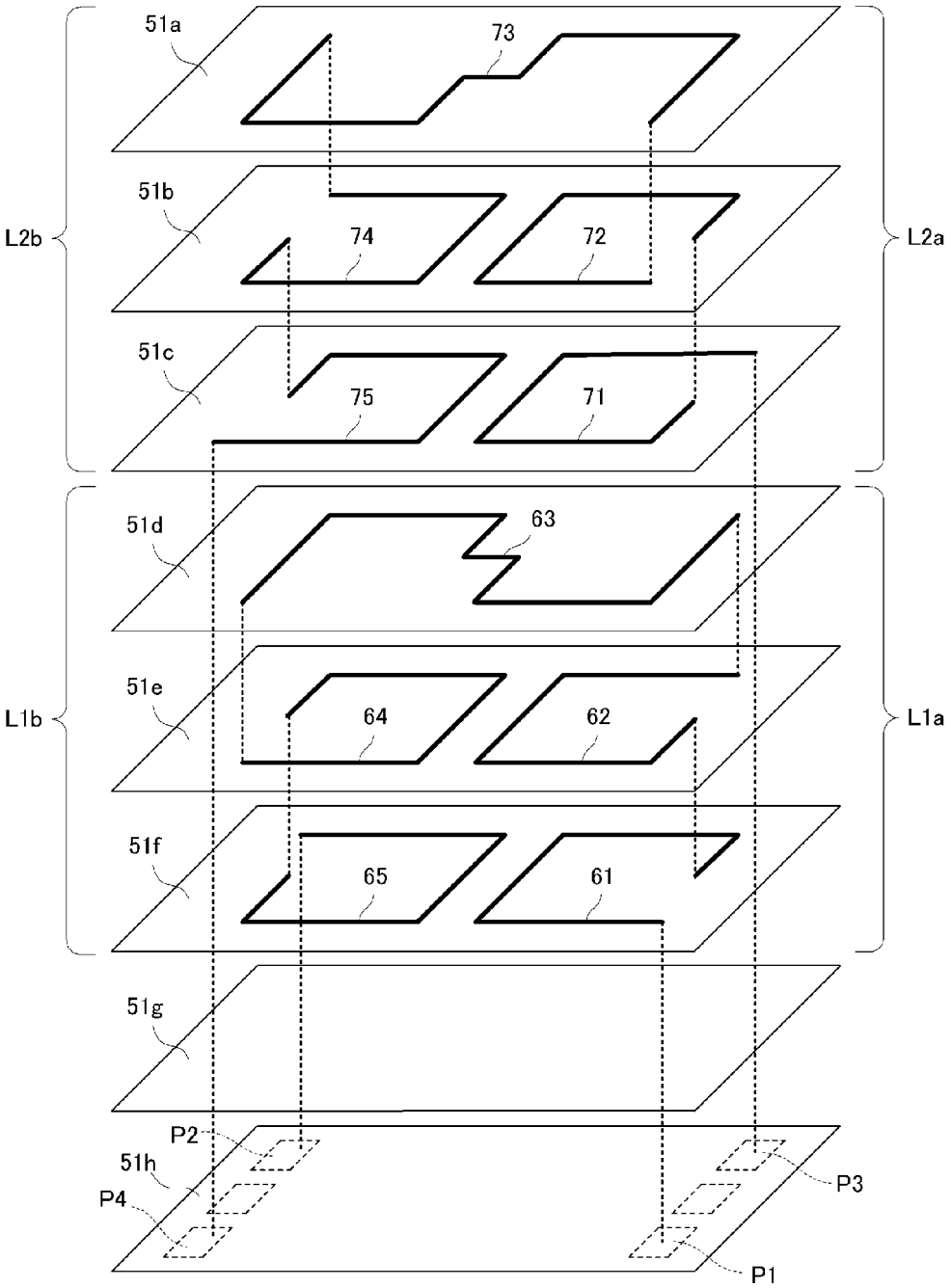
FIG. 16 shows exemplary conductor patterns of layers in a case in which the transformer having a high degree of coupling 35 according to a seventh preferred embodiment of the present invention is included in a multilayer board.

FIG. 16 shows exemplary conductor patterns of layers in a case in which the transformer having a high degree of coupling 35 according to a seventh preferred embodiment is provided in a multilayer board. Each layer is preferably defined by a magnetic sheet. Although the conductor pattern of each layer is provided on the rear surface of the magnetic sheet in the direction shown in FIG. 16, each conductor pattern is represented by a solid line. Although each linear conductor pattern has a certain line width, the linear conductor pattern is represented by the simple solid line in FIG. 16.

In the range shown in FIG. 16, the conductor pattern is provided on the rear surface of the base layer 51*a*, the conductor pattern 72 and a conductor pattern 74 are provided on the rear surface of the base layer 51*b*, and the conductor pattern 71 and a conductor pattern 75 are provided on the rear surface of the base layer 51*c*. The conductor pattern 63 is provided on the rear surface of the base layer 51*d*, the conductor patterns 62 and 64 are provided on the rear surface of the base layer 51*e*, and the conductor patterns 61 and 65 are provided on the rear surface of the base layer 51*f*. The conductor pattern 66 is provided on the rear surface of the base layer 51*g* and the ports P1, P2, P3, and P4 are provided on the rear surface of a base layer 51*h*. Dotted lines that vertically extend in FIG. 16 denote via electrodes that connects the conductor patterns to each other between the layers. Although these via electrodes are practically cylindrical electrodes each having a certain diameter, the via electrodes are represented by the simple dotted lines in FIG. 16.

Referring to FIG. 16, the right half of the conductor pattern 63 and the conductor patterns 61 and 62 define the first coil element L1*a*. The left half of the conductor pattern 63 and the conductor patterns 64 and 65 define the second coil element L1*b*. The right half of the conductor pattern 73 and the conductor patterns 71 and 72 define the third coil element L2*a*. The left half of the conductor pattern 73 and the conductor patterns 74 and 75 define the fourth coil element L2*b*. The winding axis of each of the coil elements L1*a*, L1*b*, L2*a*, and L2*b* is directed to the lamination direction of the multilayer board. The winding axis of the first coil element L1*a* is juxtaposed with the winding axis of the second coil element L1*b* in a different manner. Similarly, the winding axis of the third coil element L2*a* is juxtaposed with the winding axis of the fourth coil element L2*b* in a different manner. The winding range of the first coil element L1*a* is at least partially overlaid or overlapped with that of the third coil element L2*a* in a plan view and the winding rage of the second coil element L1*b* is at least partially overlaid or overlapped with that of the fourth coil element L2*b* in a plan view. In the example in FIG. 16, the winding range of the first coil element L1*a* substantially coincides with that of the third coil element L2*a* in a plan view and the winding rage of the second coil element L1*b* substantially coincides with that of the fourth coil element L2*b* in a plan view. The conductor patterns each having a figure-of-eight configuration define the four coil elements in the above manner.

Each layer may be defined of a dielectric sheet, for example. However, a magnetic sheet having high relative permeability can be used to further increase the coupling coefficient between the coil elements.

Figure 17:
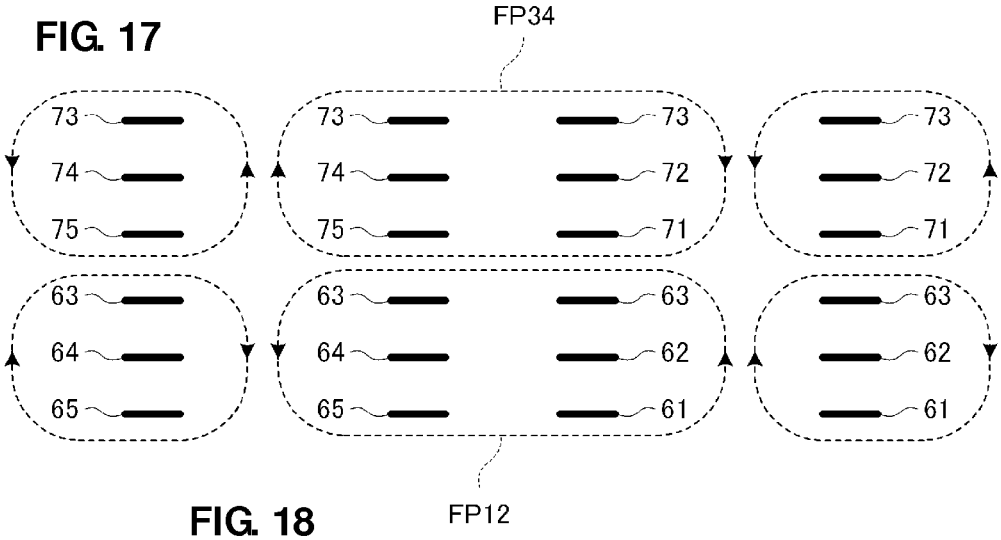
FIG. 17 shows main magnetic fluxes passing through the coil elements including the conductor patterns provided on the respective layers of the multilayer board shown in FIG. 16.

FIG. 17 shows main magnetic fluxes passing through the coil elements including the conductor patterns formed on the respective layers of the multilayer board shown in FIG. 16. A magnetic flux FP12 passes through the first coil element L1*a* including the conductor patterns 61 to 63 and the second coil element L1*b* including the conductor patterns 63 to 65. A magnetic flux FP34 passes through the third coil element L2*a* including the conductor patterns 71 to 73 and the fourth coil element L2*b* including the conductor patterns 73 to 75.

Figure 18:
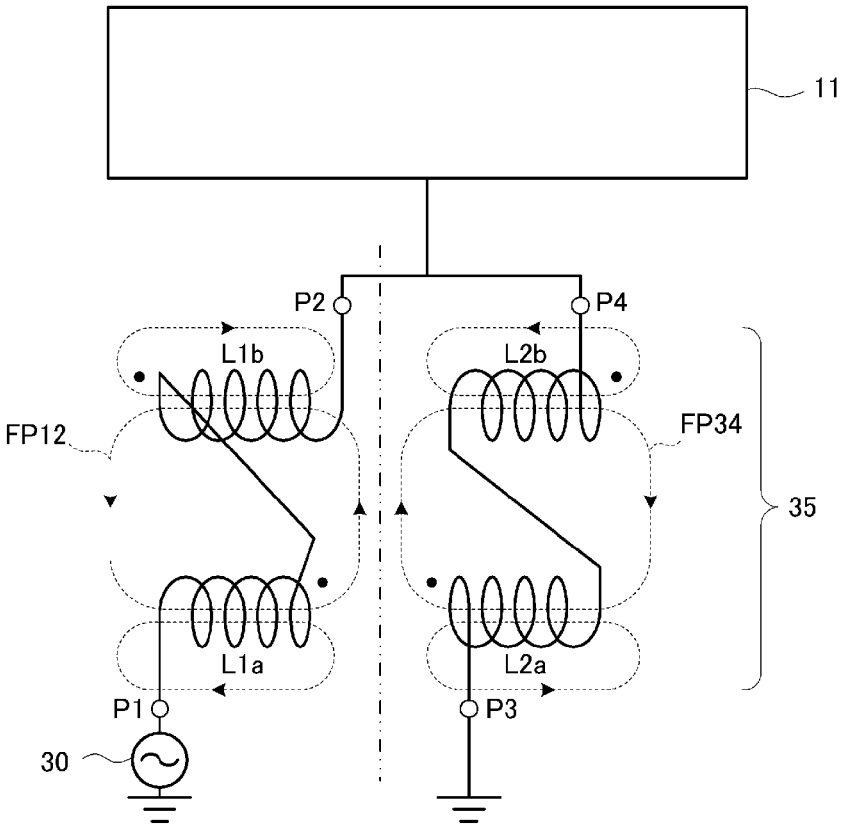
FIG. 18 shows the relationship of the magnetic coupling between four coil elements L1*a*, L1*b*, L2*a*, and L2*b* of the transformer having a high degree of coupling 35 according to the seventh preferred embodiment of the present invention.

FIG. 18 shows the relationship of the magnetic coupling between the four coil elements L1*a*, L1*b*, L2*a*, and L2*b* of the transformer having a high degree of coupling 35 according to the seventh preferred embodiment. As shown in FIG. 18, the first coil element L1*a* and the second coil element L1*b* are wound such that the first coil element L1*a* and the second coil element L1*b* define a first closed magnetic circuit (a loop indicated by the magnetic flux FP12), and the third coil element L2*a* and the fourth coil element L2*b* are wound such that the third coil element L2*a* and the fourth coil element L2*b* define a second closed magnetic circuit (a loop indicated by the magnetic flux FP34). The four coil elements L1*a*, L1*b*, L2*a*, and L2*b* are wound in the above manner such that the direction of the magnetic flux FP12 passing through the first closed magnetic circuit is opposite to that of the magnetic flux FP34 passing through the second closed magnetic circuit. A straight double dotted chain line in FIG. 18 represents a magnetic barrier preventing the two magnetic fluxes FP12 and FP34 from being coupled to each other. The magnetic barrier occurs between the coil elements L1*a* and L2*a* and between the coil elements L1*b* and L2*b* in the above manner.

Eighth Preferred Embodiment

Figure 19:
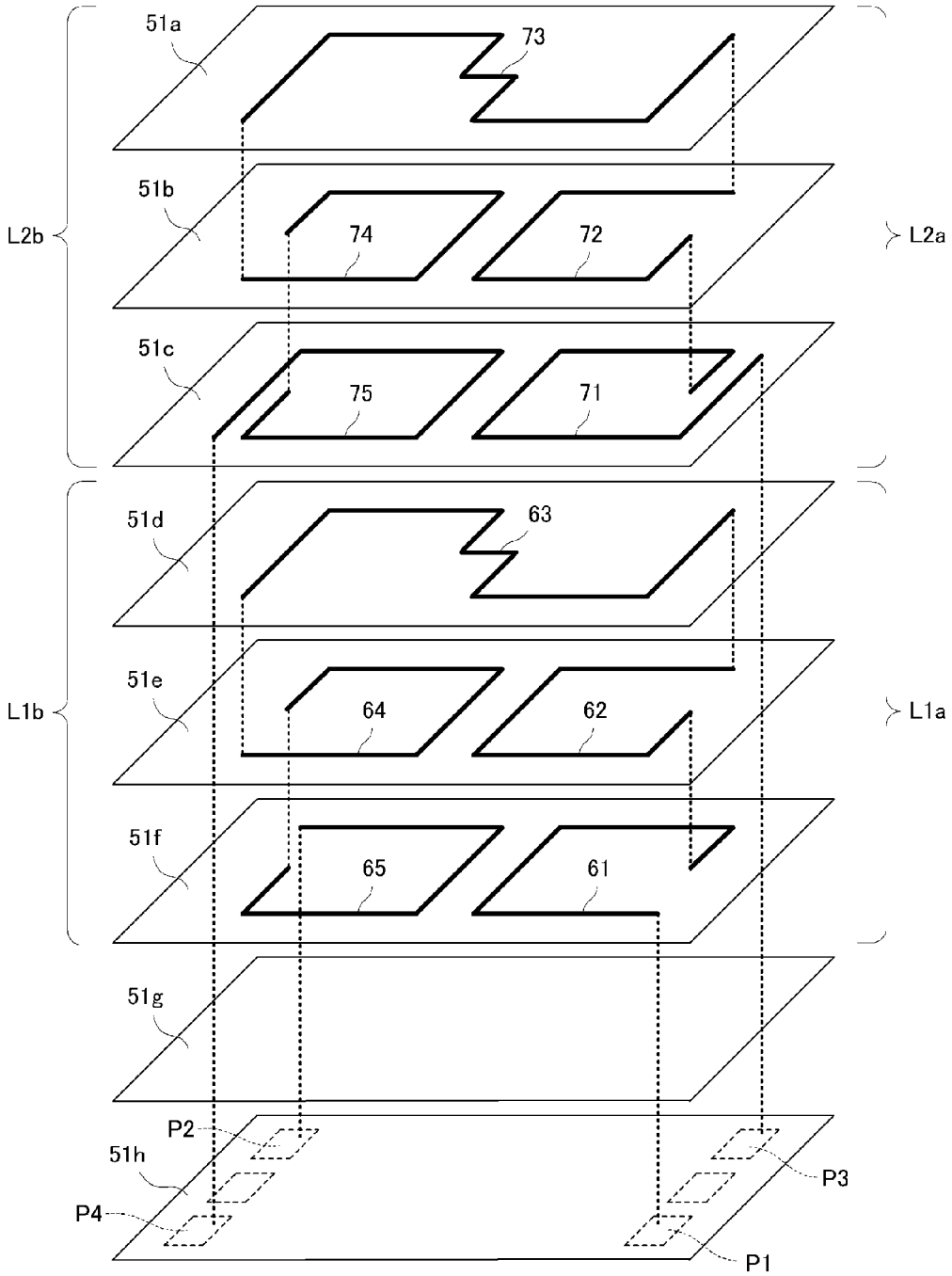
FIG. 19 shows the configuration of a transformer having a high degree of coupling according to an eighth preferred embodiment of the present invention and shows exemplary conductor patterns of layers in a case in which the transformer having a high degree of coupling is provided in a multilayer board.

FIG. 19 shows the configuration of a transformer having a high degree of coupling according to an eighth preferred embodiment. Exemplary conductor patterns of layers in a case in which the transformer having a high degree of coupling is provided in a multilayer board are shown in FIG. 19. Although the conductor pattern of each layer is provided on the rear surface of the magnetic sheet in the direction shown in FIG. 19, each conductor pattern is represented by a solid line. Although each linear conductor pattern has a certain line width, the linear conductor pattern is represented by the simple solid line in FIG. 19.

In the range shown in FIG. 19, the conductor pattern is provided on the rear surface of the base layer 51*a*, the conductor patterns 72 and 74 are provided on the rear surface of the base layer 51*b*, and the conductor patterns 71 and 75 are provided on the rear surface of the base layer 51*c*. The conductor pattern 63 is provided on the rear surface of the base layer 51*d*, the conductor patterns 62 and 64 are provided on the rear surface of the base layer 51*e*, and the conductor patterns 61 and 65 are provided on the rear surface of the base layer 51*f*. The conductor pattern 66 is provided on the rear surface of the base layer 51*g* and the ports P1, P2, P3, and P4 are provided on the rear surface of the base layer 51*h*. Dotted lines that vertically extend in FIG. 19 denote via electrodes that connects the conductor patterns to each other between the layers. Although these via electrodes are practically cylindrical electrodes each having a certain diameter, the via electrodes are represented by the simple dotted lines in FIG. 19.

Referring to FIG. 19, the right half of the conductor pattern 63 and the conductor patterns 61 and 62 define the first coil element L1*a*. The left half of the conductor pattern 63 and the conductor patterns 64 and 65 define the second coil element L1*b*. The right half of the conductor pattern 73 and the conductor patterns 71 and 72 define the third coil element L2*a*. The left half of the conductor pattern 73 and the conductor patterns 74 and 75 define the fourth coil element L2*b*.

Figure 20:
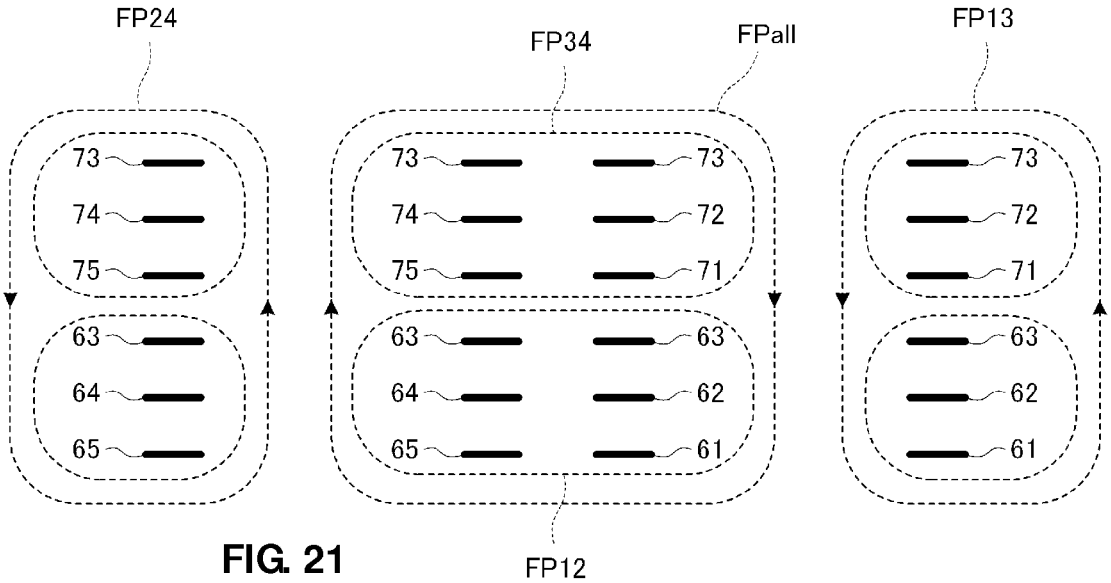
FIG. 20 shows main magnetic fluxes passing through the coil elements including the conductor patterns provided on the respective layers of the multilayer board shown in FIG. 19.
Figure 21:
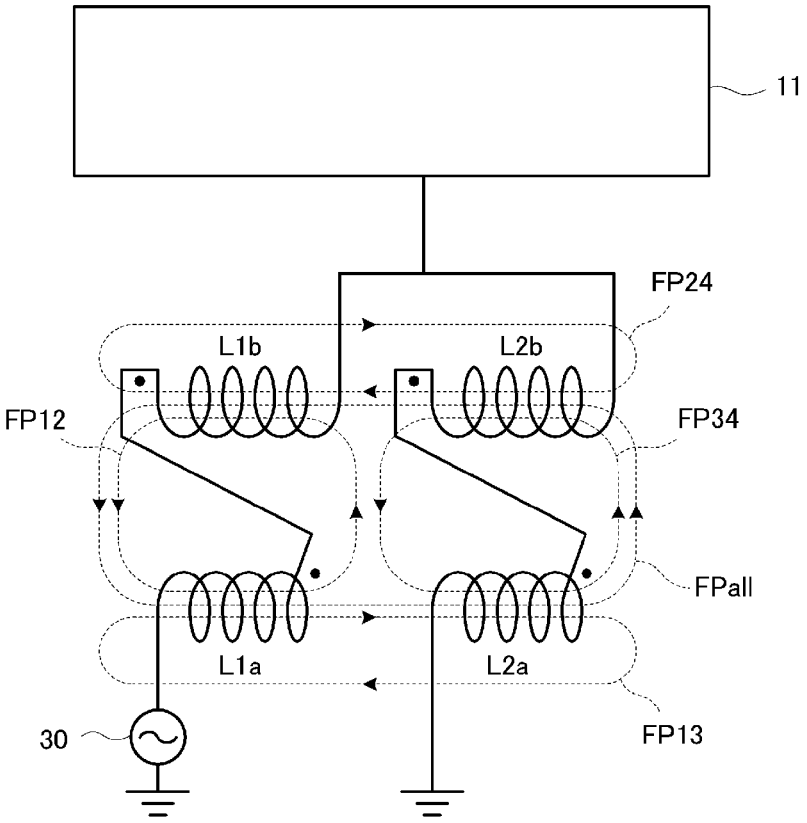
FIG. 21 shows the relationship of the magnetic coupling between the four coil elements L1*a*, L1*b*, L2*a*, and L2*b* of the transformer having a high degree of coupling according to the eighth preferred embodiment of the present invention.

FIG. 20 shows main magnetic fluxes passing through the coil elements including the conductor patterns provided on the respective layers of the multilayer board shown in FIG. 19. FIG. 21 shows the relationship of the magnetic coupling between the four coil elements L1*a*, L1*b*, L2*a*, and L2*b* of the transformer having a high degree of coupling according to the eighth preferred embodiment. The closed magnetic circuit including the first coil element L1*a* and the second coil element L1*b* is provided, as shown by the magnetic flux FP12, and the closed magnetic circuit including the third coil element L2*a* and the fourth coil element L2*b* is provided, as shown by the magnetic flux FP34. In addition, a closed magnetic circuit including the first coil element L1*a* and the third coil element L2*a* is provided, as shown by a magnetic flux FP13, and a closed magnetic circuit including the second coil element L1*b* and the fourth coil element L2*b* is provided, as shown by a magnetic flux FP24. Furthermore, a closed magnetic circuit FPall including the four coil elements L1*a*, L1*b*, L2*a*, and L2*b* is also provided.

Since the inductance values of the coil elements L1*a* and L1*b* and the inductance values of the coil elements L2*a* and L2*b* are made small due to the coupling between the coil elements L1*a* and L1*b* and the coupling between the coil elements L2*a* and L2*b*, respectively, also in the configuration of the eighth preferred embodiment, the transformer having a high degree of coupling of the eighth preferred embodiment also has the same effects as those of the transformer having a high degree of coupling 35 of the sixth preferred embodiment.

Ninth Preferred Embodiment

Figure 22:
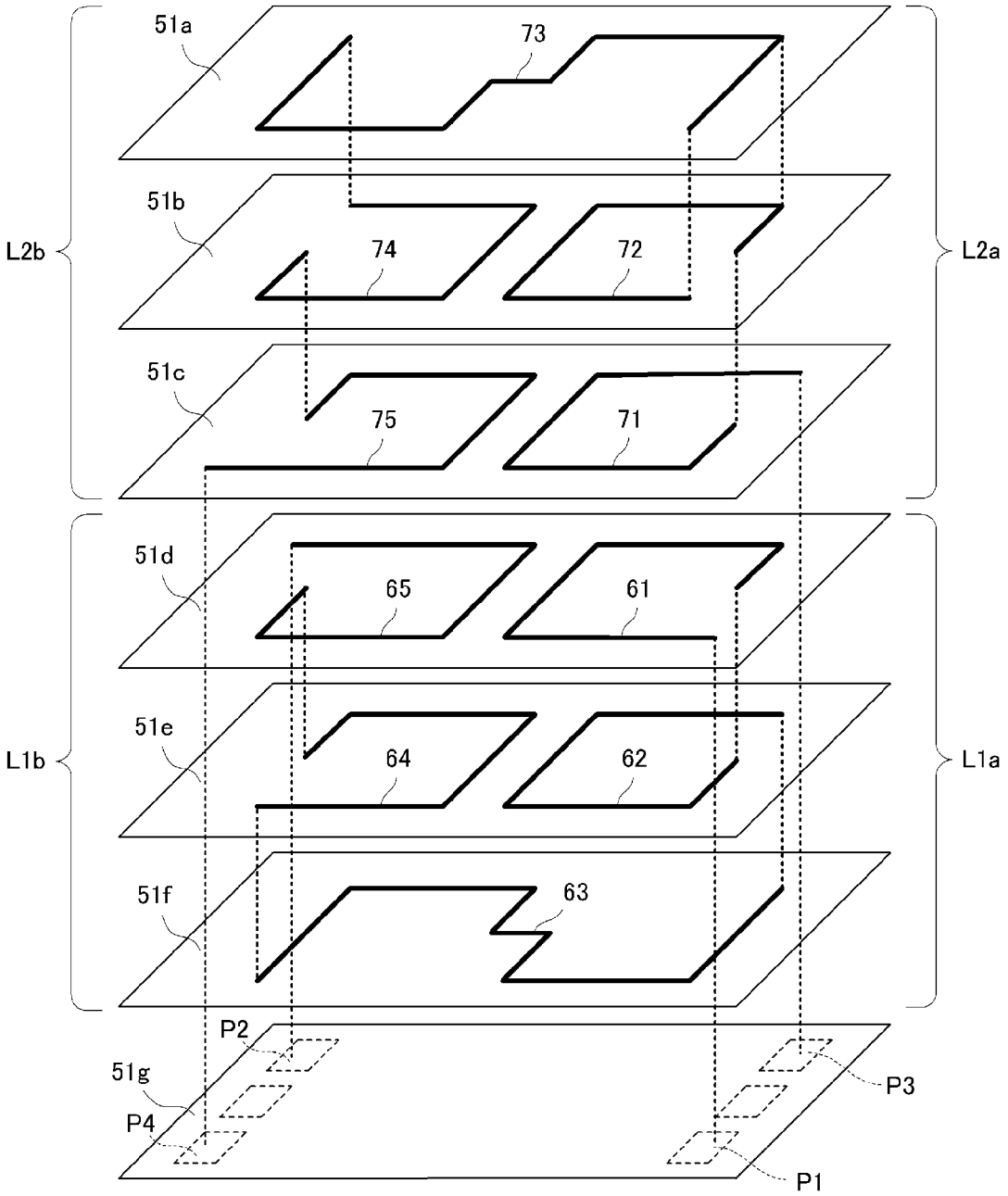
FIG. 22 shows exemplary conductor patterns of the respective layers of a transformer having a high degree of coupling according to a ninth preferred embodiment of the present invention provided in a multilayer board.

FIG. 22 shows exemplary conductor patterns of the respective layers of a transformer having a high degree of coupling according to a ninth preferred embodiment provided in a multilayer board. Each layer is preferably defined by a magnetic sheet, for example. Although the conductor pattern of each layer is provided on the rear surface of the magnetic sheet in the direction shown in FIG. 22, each conductor pattern is represented by a solid line. Although each linear conductor pattern has a certain line width, the linear conductor pattern is represented by the simple solid line in FIG. 22.

In the range shown in FIG. 22, the conductor pattern is provided on the rear surface of the base layer 51*a*, the conductor patterns 72 and 74 are provided on the rear surface of the base layer 51*b*, and the conductor patterns 71 and 75 are provided on the rear surface of the base layer 51*c*. The conductor patterns 61 and 65 are provided on the rear surface of the base layer 51*d*, the conductor patterns 62 and 64 are provided on the rear surface of the base layer 51*e*, and the conductor pattern 63 is provided on the rear surface of the base layer 51*f*. The ports P1, P2, P3, and P4 are provided on the rear surface of the base layer 51*g*. Dotted lines that vertically extend in FIG. 22 denote via electrodes that connects the conductor patterns to each other between the layers. Although these via electrodes are practically cylindrical electrodes each having a certain diameter, the via electrodes are represented by the simple dotted lines in FIG. 22.

Referring to FIG. 22, the right half of the conductor pattern 63 and the conductor patterns 61 and 62 define the first coil element L1*a*. The left half of the conductor pattern 63 and the conductor patterns 64 and 65 define the second coil element L1*b*. The right half of the conductor pattern 73 and the conductor patterns 71 and 72 define the third coil element L2*a*. The left half of the conductor pattern 73 and the conductor patterns 74 and 75 define the fourth coil element L2*b*.

Figure 23:
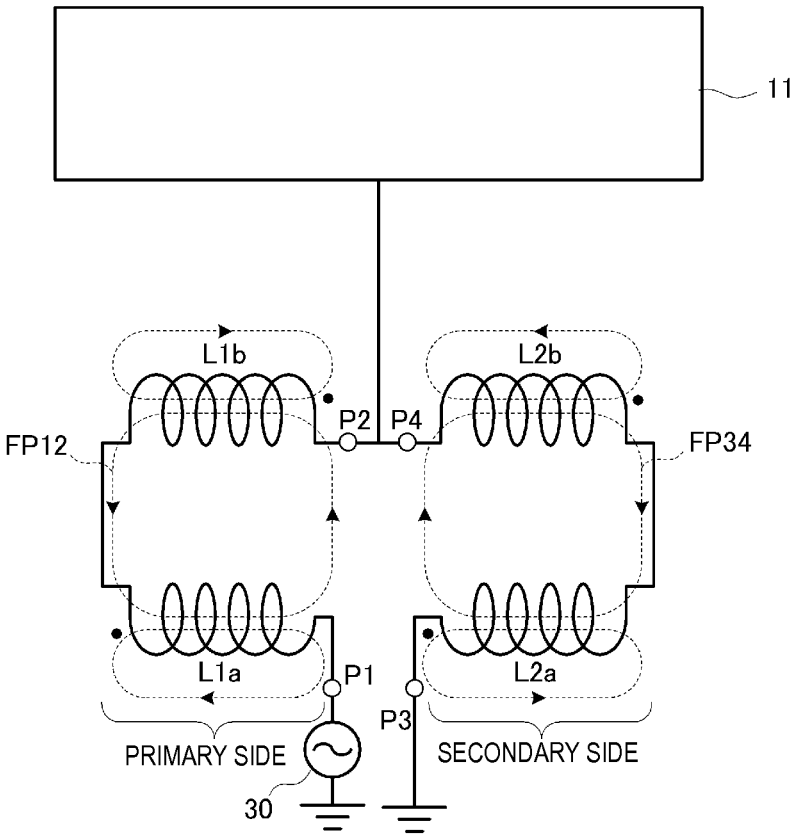
FIG. 23 shows the relationship of the magnetic coupling between the four coil elements L1*a*, L1*b*, L2*a*, and L2*b* of the transformer having a high degree of coupling according to the ninth preferred embodiment of the present invention.

FIG. 23 shows the relationship of the magnetic coupling between the four coil elements L1*a*, L1*b*, L2*a*, and L2*b* of the transformer having a high degree of coupling according to the ninth preferred embodiment. As shown in FIG. 23, the first coil element L1*a* and the second coil element L1*b* define the first closed magnetic circuit (a loop indicated by the magnetic flux FP12). The third coil element L2*a* and the fourth coil element L2*b* define the second closed magnetic circuit (a loop indicated by the magnetic flux FP34). The direction of the magnetic flux FP12 passing through the first closed magnetic circuit is opposite to that of the magnetic flux FP34 passing through the second closed magnetic circuit.

Provided that the first coil element L1*a* and the second coil element L1*b* are represented as a "primary side" and the third coil element L2*a* and the fourth coil element L2*b* are represented as a "secondary side", the power feed circuit is connected to the end of the primary side close to the secondary side, as shown in FIG. 23, and the voltage at the primary side near the secondary side is increased. Accordingly, the electric field coupling between the coil element L1*a* and the coil element L2*a* is increased to increase the current caused by the electric field coupling.

Since the inductance values of the coil elements L1*a* and L1*b* and the inductance values of the coil elements L2*a* and L2*b* are made small due to the coupling between the coil elements L1*a* and L1*b* and the coupling between the coil elements L2*a* and L2*b*, respectively, also in the configuration of the ninth preferred embodiment, the transformer having a high degree of coupling of the ninth preferred embodiment also has the same effects as those of the transformer having a high degree of coupling 35 of the sixth preferred embodiment.

Tenth Preferred Embodiment

Figure 24:
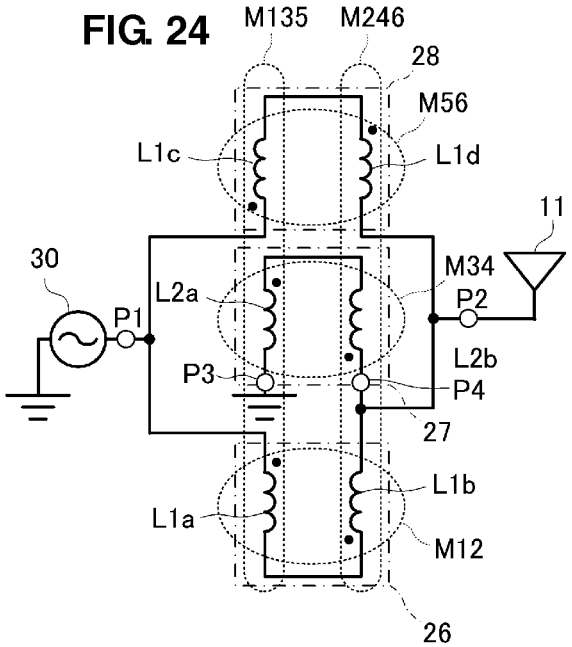
FIG. 24 is a circuit diagram of a transformer having a high degree of coupling according to a tenth preferred embodiment of the present invention.

FIG. 24 is a circuit diagram of a transformer having a high degree of coupling according to a tenth preferred embodiment. The transformer having a high degree of coupling includes a first series circuit 26 connected between the power feed circuit 30 and the antenna element 11, a third series circuit 28 connected between the power feed circuit 30 and the antenna element 11, and a second series circuit 27 connected between the antenna element 11 and the ground.

In the first series circuit 26, the first coil element L1*a* is connected in series to the second coil element L1*b*. In the second series circuit 27, the third coil element L2*a* is connected in series to the fourth coil element L2*b*. In the third series circuit 28, a fifth coil element L1*c* is connected in series to a sixth coil element L1*d*.

Referring to FIG. 24, an enclosure M12 represents the coupling between the coil elements L1*a* and L1*b*, an enclosure M34 represents the coupling between the coil elements L2*a* and L2*b*, and an enclosure M56 represents the coupling between the coil elements L1*c* and L1*d*. An enclosure M135 represents the coupling between the coil elements L1*a*, L2*a*, and L1*c*. Similarly, an enclosure M246 represents the coupling between the coil elements L1*b*, L2*b*, and L1*d*.

In the tenth preferred embodiment, the coil elements L2*a* and L2*b* defining the second inductance element are arranged so as to be sandwiched between the coil elements L1*a*, L1*b*, L1*c*, and L1*d* defining the first inductance element to suppress the stray capacitor occurring between the second inductance element and the ground. The suppression of such a capacitance component that does not contribute the radiation allows the radiation efficiency of the antenna to be improved.

Figure 25:
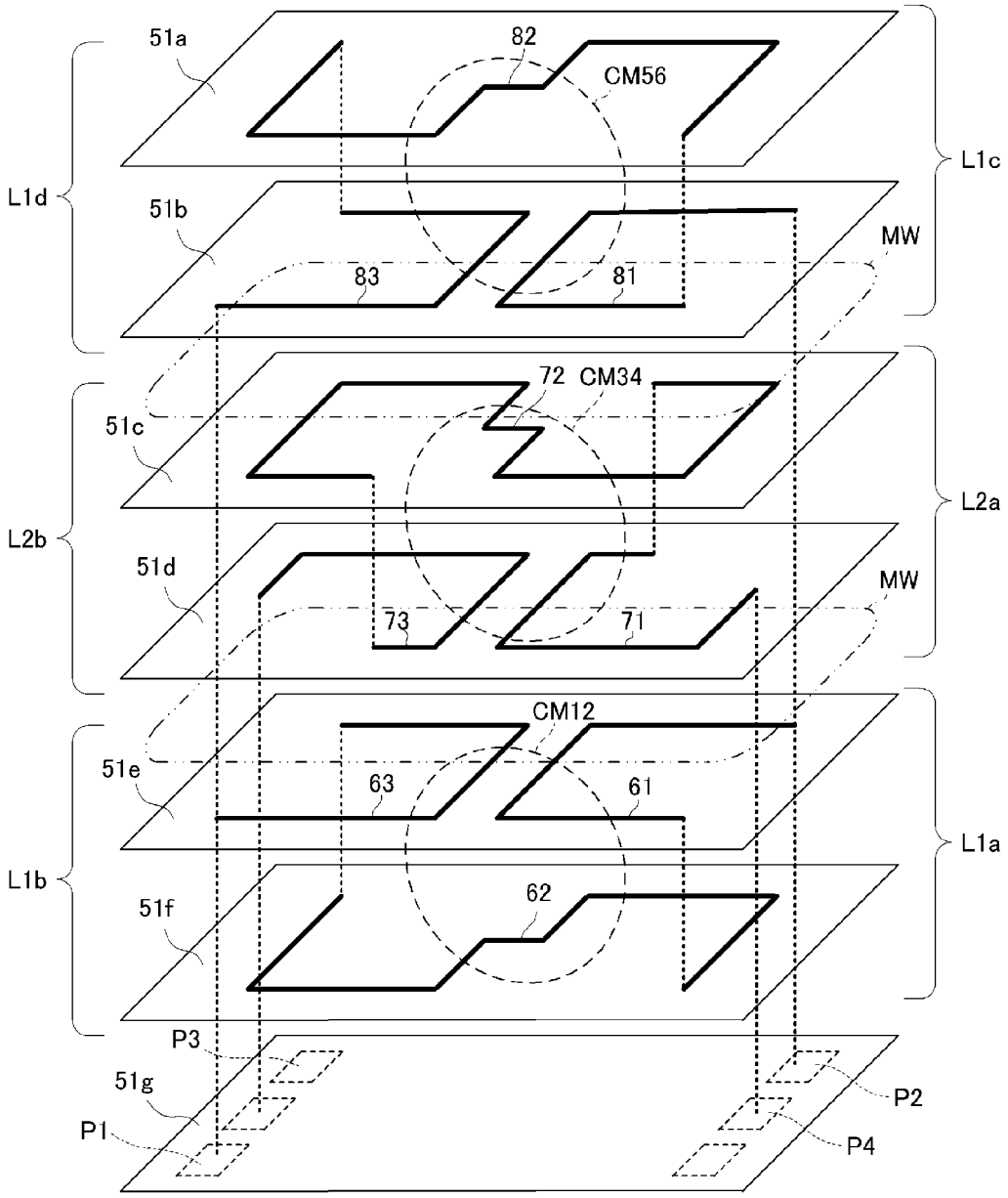
FIG. 25 shows exemplary conductor patterns of layers in a case in which the transformer having a high degree of coupling according to the tenth preferred embodiment of the present invention is provided in a multilayer board.

FIG. 25 shows exemplary conductor patterns of layers in a case in which the transformer having a high degree of coupling according to the tenth preferred embodiment is provided in a multilayer board. Each layer is preferably defined by a magnetic sheet, for example. Although the conductor pattern of each layer is provided on the rear surface of the magnetic sheet in the direction shown in FIG. 25, each conductor pattern is represented by a solid line. Although each linear conductor pattern has a certain line width, the linear conductor pattern is represented by the simple solid line in FIG. 25.

In the range shown in FIG. 25, a conductor pattern 82 is provided on the rear surface of the base layer 51*a*, conductor patterns 81 and 83 are provided on the rear surface of the base layer 51*b*, and the conductor pattern 72 is provided on the rear surface of the base layer 51*c*. The conductor patterns 71 and 73 are provided on the rear surface of the base layer 51*d*, the conductor patterns 61 and 63 are provided on the rear surface of the base layer 51*e*, and the conductor pattern 62 is provided on the rear surface of the base layer 51*f*. The ports P1, P2, P3, and P4 are provided on the rear surface of the base layer 51*g*. Dotted lines that vertically extend in FIG. 25 denote via electrodes that connects the conductor patterns to each other between the layers. Although these via electrodes are practically cylindrical electrodes each having a certain diameter, the via electrodes are represented by the simple dotted lines in FIG. 25.

Referring to FIG. 25, the right half of the conductor pattern 62 and the conductor pattern 61 define the first coil element L1*a*. The left half of the conductor pattern 62 and the conductor pattern 63 define the second coil element L1*b*. The conductor pattern 71 and the right half of the conductor pattern define the third coil element L2*a*. The left half of the conductor pattern 72 and the conductor pattern 73 define the fourth coil element L2*b*. The conductor pattern 81 and the right half of the conductor pattern 82 define the fifth coil element L1*c*. The left half of the conductor pattern 82 and the conductor pattern 83 define the sixth coil element L1*d*.

Broken-line ellipses represent the closed magnetic circuits in FIG. 25. A closed magnetic circuit CM12 links to the coil elements L1*a* and L1*b*. A closed magnetic circuit CM34 links to the coil elements L2*a* and L2*b*. A closed magnetic circuit CM56 links to the coil elements L1*c* and L1*d*. The first coil element L1*a* and the second coil element L1*b* define the first closed magnetic circuit CM12, the third coil element L2*a* and the fourth coil element L2*b* define the second closed magnetic circuit CM34, and the fifth coil element L1*c* and the sixth coil element L1*d* define the third closed magnetic circuit CM56 in the above manner. Planes represented by double dotted chain lines in FIG. 25 represent two magnetic barriers MW that equivalently occur because the coil elements L1*a* and L2*a* are coupled to each other and the coil elements L2*a* and L1*c* are coupled to each other such that the magnetic fluxes in opposite directions occur between the three closed magnetic circuits and the coil elements L1*b* and L2*b* are coupled to each other and the coil elements L2*b* and L1*d* are coupled to each other such that the magnetic fluxes in opposite directions occur between the three closed magnetic circuits. In other words, the magnetic flux of the closed magnetic circuit including the coil elements L1*a* and L1*b*, the magnetic flux of the closed magnetic circuit including the coil elements L2*a* and L2*b*, and the magnetic flux of the closed magnetic circuit including the coil elements L1*c* and L1*d* are contained by the two magnetic barriers MW.

As described above, the second closed magnetic circuit CM34 is sandwiched between the first closed magnetic circuit CM12 and the third closed magnetic circuit CM56 in the lamination direction. With this structure, the second closed magnetic circuit CM34 is sandwiched between the two magnetic barriers to be sufficiently contained (the effect of the containment is improved). In other words, it is possible to cause the transformer having a high degree of coupling to operate as a transformer having a very large coupling coefficient.

Accordingly, it is possible to increase the space between the closed magnetic circuits CM12 and CM34 and the space between the closed magnetic circuits CM34 and CM56 to some extent. Provided that a circuit in which the series circuit including the coil elements L1*a* and L1*b* is connected in parallel to the series circuit including the coil elements L1*c* and L1*d* is referred to as a primary side circuit and the series circuit including the coil elements L2*a* and L2*b* is referred to as a secondary side circuit, the increase in the space between the closed magnetic circuits CM12 and CM34 and the space between the closed magnetic circuits CM34 and CM56 allows the capacitance occurring between the first series circuit 26 and the second series circuit 27 and the capacitance occurring between the second series circuit 27 and the third series circuit 28 to be decreased. In other words, the capacitance component of an LC resonant circuit defining the frequency of a self-resonance point is decreased.

In addition, according to the tenth preferred embodiment, since the first series circuit 26 including the coil elements L1*a* and L1*b* is connected in parallel to the third series circuit 28 including the coil elements L1*c* and L1*d*, the inductance component of the LC resonant circuit defining the frequency of the self-resonance point is decreased.

Both the capacitance component and the inductance component of the LC resonant circuit defining the frequency of the self-resonance point are decreased in the above manner, so that the frequency of the self-resonance point can be set to a high frequency sufficiently apart from the frequency band that is used.

Eleventh Preferred Embodiment

An exemplary configuration to make the frequency of the self-resonance point of the transformer higher than the frequency shown in the seventh to ninth preferred embodiments with a configuration different from that in the tenth preferred embodiment is shown in an eleventh preferred embodiment.

Figure 26:
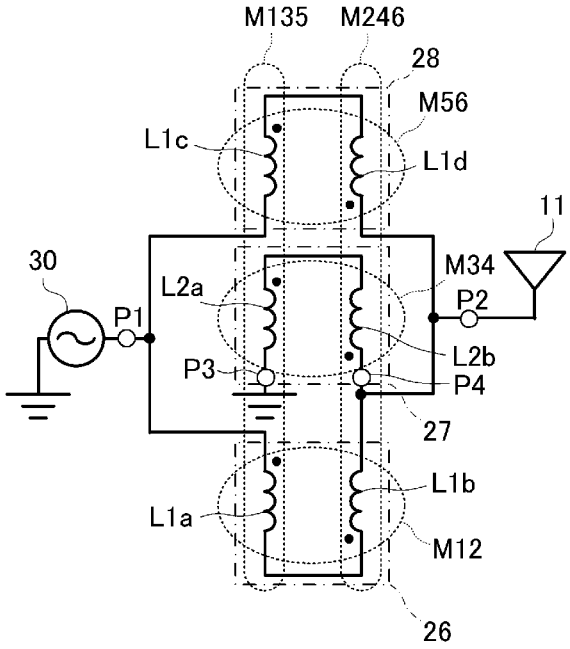
FIG. 26 is a circuit diagram of a transformer having a high degree of coupling according to an eleventh preferred embodiment of the present invention.

FIG. 26 is a circuit diagram of a transformer having a high degree of coupling according to the eleventh preferred embodiment. The transformer having a high degree of coupling includes the first series circuit 26 connected between the power feed circuit 30 and the antenna element 11, the third series circuit 28 connected between the power feed circuit 30 and the antenna element 11, and the second series circuit 27 connected between the antenna element 11 and the ground.

In the first series circuit 26, the first coil element L1*a* is connected in series to the second coil element L1*b*. In the second series circuit 27, the third coil element L2*a* is connected in series to the fourth coil element L2*b*. In the third series circuit 28, the fifth coil element L1*c* is connected in series to the sixth coil element L1*d*.

Referring to FIG. 26, the enclosure M12 represents the coupling between the coil elements L1*a* and L1*b*, the enclosure M34 represents the coupling between the coil elements L2*a* and L2*b*, and the enclosure M56 represents the coupling between the coil elements L1*c* and L1*d*. The enclosure M135 represents the coupling between the coil elements L1*a*, L2*a*, and L1*c*. Similarly, the enclosure M246 represents the coupling between the coil elements L1*b*, L2*b*, and L1*d*.

Figure 27:
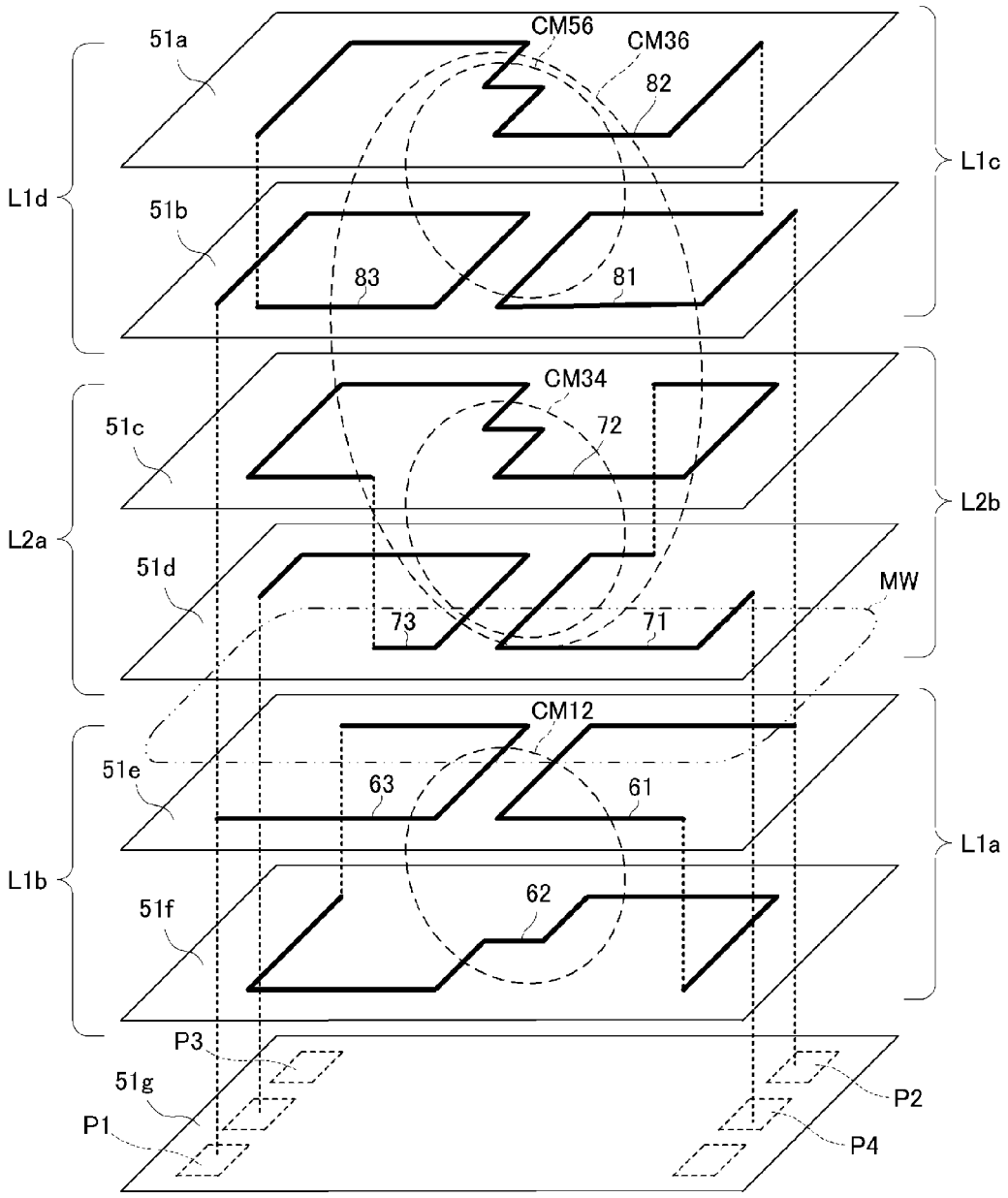
FIG. 27 shows exemplary conductor patterns of layers in a case in which the transformer having a high degree of coupling according to the eleventh preferred embodiment of the present invention is provided in a multilayer board.

FIG. 27 shows exemplary conductor patterns of layers in a case in which the transformer having a high degree of coupling according to the eleventh preferred embodiment is provided in a multilayer board. Each layer is preferably defined by a magnetic sheet, for example. Although the conductor pattern of each layer is provided on the rear surface of the magnetic sheet in the direction shown in FIG. 27, each conductor pattern is represented by a solid line. Although each linear conductor pattern has a certain line width, the linear conductor pattern is represented by the simple solid line in FIG. 27.

The transformer having a high degree of coupling in FIG. 27 differs from the transformer having a high degree of coupling shown in FIG. 25 in the polarity of the coil elements L1*c* and L1*d* including the conductor patterns 81, 82, and 83. In the example in FIG. 27, a closed magnetic circuit CM36 links to the coil elements L2*a*, L1*c*, L1*d*, and L2*b*. Accordingly, no equivalent magnetic barrier occurs between the coil elements L2*a* and L2*b* and the coil elements L1*c* and L1*d*. The remaining configuration is preferably the same as that in the tenth preferred embodiment.

According to the eleventh preferred embodiment, the closed magnetic circuit CM36 occurs, in addition to the closed magnetic circuits CM12, CM34, and CM56 shown in FIG. 27, to absorb the magnetic flux caused by the coil elements L2*a* and L2*b* into the magnetic flux caused by the coil elements L1*c* and L1*d*. Accordingly, the magnetic flux is difficult to leak out also in the configuration in the eleventh preferred embodiment. As a result, it is possible to cause the transformer having a high degree of coupling to operate as a transformer having a very large coupling coefficient.

Both the capacitance component and the inductance component of the LC resonant circuit defining the frequency of the self-resonance point are decreased also in the eleventh preferred embodiment, so that the frequency of the self-resonance point can be set to a high frequency sufficiently apart from the frequency band that is used.

Twelfth Preferred Embodiment

Another exemplary configuration to make the frequency of the self-resonance point of the transformer higher than the frequency shown in the seventh to ninth preferred embodiments with a configuration different from those in the tenth preferred embodiment and the eleventh preferred embodiment is shown in a twelfth preferred embodiment.

Figure 28:
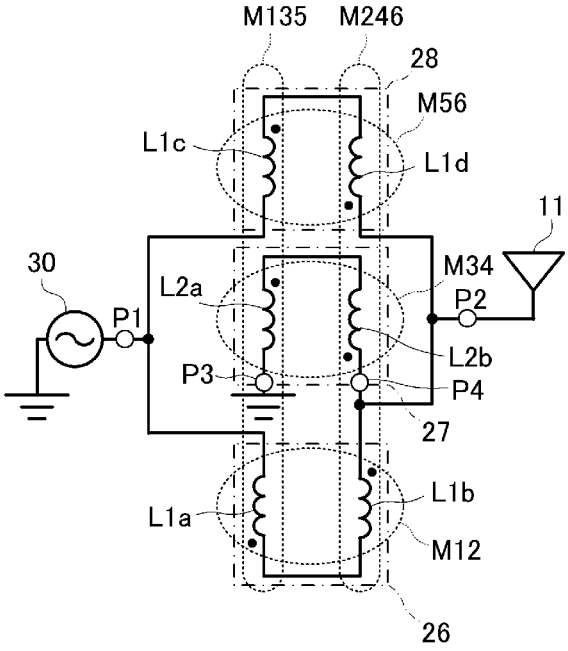
FIG. 28 is a circuit diagram of a transformer having a high degree of coupling according to a twelfth preferred embodiment of the present invention.

FIG. 28 is a circuit diagram of a transformer having a high degree of coupling according to the twelfth preferred embodiment. The transformer having a high degree of coupling includes the first series circuit 26 connected between the power feed circuit 30 and the antenna element 11, the third series circuit 28 connected between the power feed circuit 30 and the antenna element 11, and the second series circuit 27 connected between the antenna element 11 and the ground.

Figure 29:
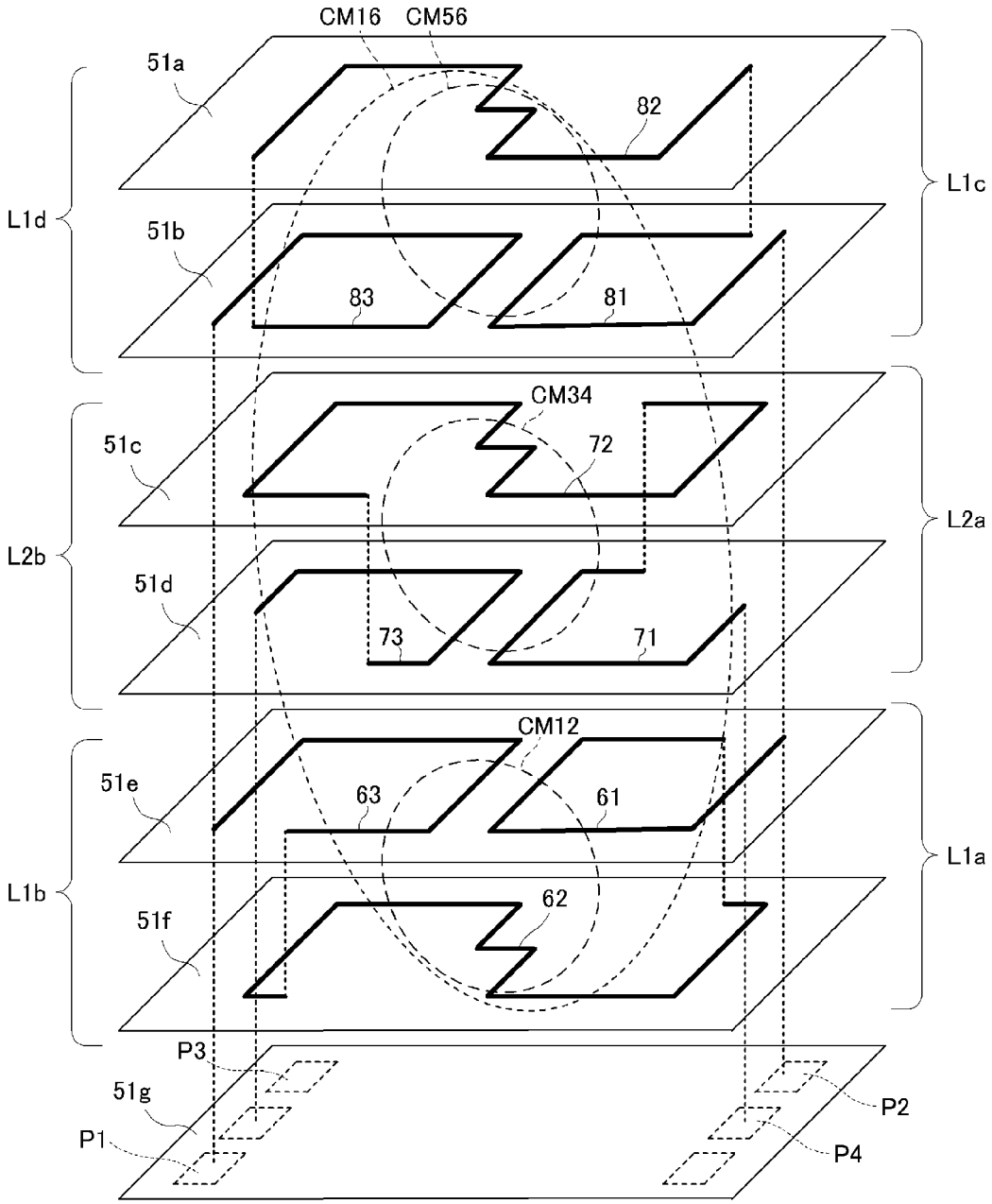
FIG. 29 shows exemplary conductor patterns of layers in a case in which the transformer having a high degree of coupling according to the twelfth preferred embodiment of the present invention is provided in a multilayer board.

FIG. 29 shows exemplary conductor patterns of layers in a case in which the transformer having a high degree of coupling according to the twelfth preferred embodiment is provided in a multilayer board. Each layer is preferably defined by a magnetic sheet, for example. Although the conductor pattern of each layer is provided on the rear surface of the magnetic sheet in the direction shown in FIG. 29, each conductor pattern is represented by a solid line. Although each linear conductor pattern has a certain line width, the linear conductor pattern is represented by the simple solid line in FIG. 29.

The transformer having a high degree of coupling in FIG. 29 differs from the transformer having a high degree of coupling shown in FIG. 25 in the polarity of the coil elements L1*a* and L1*db* including the conductor patterns 61, 62, and 63 and the polarity of the coil elements L1*c* and L1*d* including the conductor patterns 81, 82, and 83. In the example in FIG. 29, a closed magnetic circuit CM16 links to all the coil elements L1*a* to L1*d*, L2*a*, and L2*b*. Accordingly, no equivalent magnetic barrier occurs in this case. The remaining configuration is preferably the same as those in the tenth preferred embodiment and the eleventh preferred embodiment.

According to the twelfth preferred embodiment, the occurrence of the closed magnetic circuit CM16, in addition to the closed magnetic circuits CM12, CM34, and CM56 shown in FIG. 29, makes the magnetic flux caused by the coil elements L1*a* to L1*d* difficult to leak out. As a result, it is possible to cause the transformer having a high degree of coupling to operate as a transformer having a large coupling coefficient.

Both the capacitance component and the inductance component of the LC resonant circuit defining the frequency of the self-resonance point are decreased also in the twelfth preferred embodiment, so that the frequency of the self-resonance point can be set to a high frequency sufficiently apart from the frequency band that is used.

Thirteenth Preferred Embodiment

Examples of a communication terminal apparatus are shown in a thirteenth preferred embodiment.

Figure 30A:
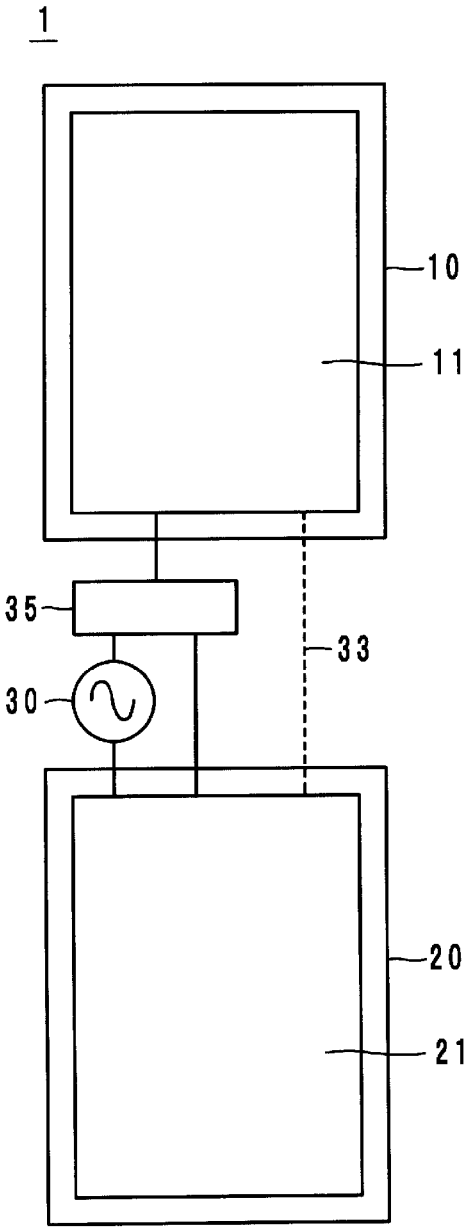
FIG. 30A shows the configuration of a communication terminal apparatus of a first example of a thirteenth preferred embodiment of the present invention and FIG. 30B shows the configuration of a communication terminal apparatus of a second example of the thirteenth preferred embodiment of the present invention.
Figure 30B:
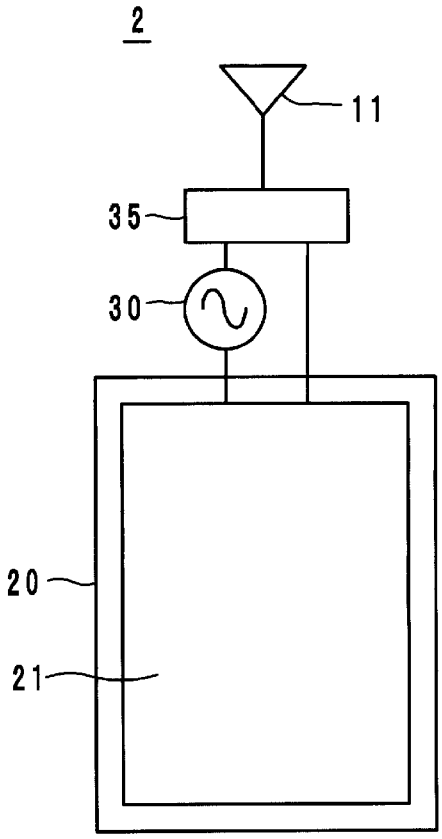

FIG. 30A shows the configuration of a communication terminal apparatus of a first example of the thirteenth preferred embodiment. FIG. 30B shows the configuration of a communication terminal apparatus of a second example of the thirteenth preferred embodiment. These communication terminal apparatuses are, for example, for use as terminals for reception of radio-frequency signals (e.g., about 470 MHz to about 770 MHz) in one-segment partial reception service for mobile terminals such as cellular phones (commonly called One seg).

A communication terminal apparatus 1 shown in FIG. 30A includes a first casing 10, which is a lid portion, and a second casing 20, which is a main body portion. The first casing 10 is connected to the second casing 20 in a foldable manner or a slidable manner. A first radiation element 11, which also functions as a ground plate, is provided in the first casing 10. A second radiation element 21, which also functions as a ground plate, is provided in the second casing 20. The first and second radiation elements 11 and 21 are each preferably defined by a conductive film, which is a thin film such as a metal foil or a thick film such as conductive paste. The first and second radiation elements 11 and 21 receive differential power supply from the power feed circuit 30 to achieve the performance substantially similar to that of a dipole antenna. The power feed circuit 30 includes signal processing circuits, such as a radio-frequency (RF) circuit and a baseband circuit.

The inductance value of the transformer having a high degree of coupling 35 is preferably smaller than the inductance value of a connection line 33 connecting the two radiation elements 11 and 21. This is because it is possible to reduce the effect of the inductance value of the connection line 33 concerning frequency characteristics in the above case.

A communication terminal apparatus 2 shown in FIG. 30B includes the first radiation element 11 as a single antenna. Various antenna elements including a chip antenna, a sheet metal antenna, and a coil antenna can be used as the first radiation element 11. For example, a linear conductor provided along the inner periphery or the outer periphery of the casing 10 may be used as this antenna element. The second radiation element 21 also functions as the ground plate for the second casing 20 and various antennas may be used as the second radiation element 21, as in the first radiation element 11. The communication terminal apparatus 2 is a straight terminal, which is not a foldable or slidable terminal. The second radiation element 21 may not sufficiently function as the radiator and the first radiation element 11 may behave like a so-called monopole antenna.

One end of the power feed circuit 30 is connected to the second radiation element 21 and the other end thereof is connected to the first radiation element 11 via the transformer having a high degree of coupling 35. The first radiation element 11 is connected to the second radiation element 21 via the connection line 33. The connection line 33 functions as a connection line for electronic devices (not shown) installed in each of the first and second casings 10 and 20. The connection line 33 behaves as an inductance element for the radio-frequency signals but does not directly affect the performance of the antenna.

The transformer having a high degree of coupling 35 is provided between the power feed circuit 30 and the first radiation element 11 and stabilizes the radio-frequency signals transmitted from the first and second radiation elements 11 and or the radio-frequency signals received by the first and second radiation elements 11 and 21. Accordingly, the frequency characteristics of the radio-frequency signals are stabilized without the effects of the shapes of the first radiation element 11 and the second radiation element 21, the shapes of the first casing 10 and the second casing 20, and/or the status of arrangement of adjacent elements. In particular, although the impedances of the first and second radiation elements 11 and 21 are likely to be varied depending on the opening-closing state of the first casing 10, which is the lid portion, with respect to the second casing 20, which is the main body portion, in the foldable and slidable communication terminal apparatuses, the provision of the transformer having a high degree of coupling 35 allows the frequency characteristics of the radio-frequency signals to be stabilized. Specifically, the transformer having a high degree of coupling 35 can serve the function of adjusting the frequency characteristics, such as setting of the center frequency, setting of the pass band width, and setting of impedance matching, which are important matters for design of the antenna. Accordingly, it is sufficient to mainly consider the directivity and the gain in the antenna element itself, thus facilitating the design of the antenna.

The transformer having a high degree of coupling of various preferred embodiments of the present invention is applicable to radio-frequency electronic circuits, such as voltage step-up and step-down circuits, current transformation and shunt circuits, and balance-unbalance conversion circuits, for example, in addition to the impedance conversion circuits described above. In addition, the radio-frequency electronic circuits are applicable to electronic devices, such as mobile communication terminals, Radio Frequency Identification (RFID) tags and reader-writers, televisions, and personal computers, for example.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A high-frequency transformer comprising:

a first inductance element; and a second inductance element coupled to the first inductance element; wherein the first inductance element includes a first coil element and a second coil element;

the first coil element and the second coil element have different coil winding axes and are connected to each other in a direction so as to be coupled to each other in opposite phases;

the second inductance element includes a third coil element and a fourth coil element;

the third coil element and the fourth coil element have different coil winding axes and are connected to each other in a direction so as to be coupled to each other in opposite phases;

the first coil element and the third coil element are arranged such that coil opening surfaces of the first coil element and the third coil element overlap each other in plan view;

the second coil element and the fourth coil element are arranged such that coil opening surfaces of the second coil element and the fourth coil element overlap each other in plan view;

the first coil element and the second coil element are connected in series to each other;

the third coil element and the fourth coil element are connected in series to each other; and the first inductance element and the second inductance element are coupled to each other via a magnetic field and an electric field.

2. The high-frequency transformer according to claim 1, wherein, when high-frequency current flows through the first inductance element, a direction of high-frequency current flowing through the second inductance element is a direction along which a magnetic barrier occurs between the first inductance element and the second inductance element.

3. The high-frequency transformer according to claim 1, wherein winding patterns of conductors of the first coil element and the second coil element are arranged to define a closed magnetic circuit.

4. The high-frequency transformer according to claim 1, wherein winding patterns of conductors of the third coil element and the fourth coil element are arranged to define a closed magnetic circuit.

5. The high-frequency transformer according to claim 1, wherein the first inductance element and the second inductance element include conductor patterns arranged in a multilayer body in which a plurality of dielectric layers or magnetic layers are stacked, and the first inductance element and the second inductance element are coupled to each other in the multilayer body.

6. An electronic circuit comprising:

a high-frequency transformer including a first inductance element and a second inductance element coupled to the first inductance element; wherein the first inductance element includes a first coil element and a second coil element;

the first coil element and the second coil element have different coil winding axes and are connected to each other in a direction so as to be coupled to each other in opposite phases;

the second inductance element includes a third coil element and a fourth coil element;

the third coil element and the fourth coil element have different coil winding axes and are connected to each other in a direction so as to be coupled to each other in opposite phases;

the first coil element and the third coil element are arranged such that coil opening surfaces of the first coil element and the third coil element overlap each other in plan view;

the second coil element and the fourth coil element are arranged such that coil opening surfaces of the second coil element and the fourth coil element overlap each other in plan view;

the first coil element and the second coil element are connected in series to each other;

the third coil element and the fourth coil element are connected in series to each other; and the first inductance element and the second inductance element are coupled to each other via a magnetic field and an electric field;

a primary side circuit connected to the first inductance element; and a secondary side circuit connected to the second inductance element.

7. An electronic device comprising:

a high-frequency transformer including a first inductance element and a second inductance element coupled to the first inductance element; wherein the first inductance element includes a first coil element and a second coil element;

the first coil element and the second coil element have different coil winding axes and are connected to each other in a direction so as to be coupled to each other in opposite phases;

the second inductance element includes a third coil element and a fourth coil element;

the third coil element and the fourth coil element have different coil winding axes and are connected to each other in a direction so as to be coupled to each other in opposite phases;

the first coil element and the third coil element are arranged such that coil opening surfaces of the first coil element and the third coil element overlap each other in plan view;

the second coil element and the fourth coil element are arranged such that coil opening surfaces of the second coil element and the fourth coil element overlap each other in plan view;

the first coil element and the second coil element are connected in series to each other;

the third coil element and the fourth coil element are connected in series to each other; and the first inductance element and the second inductance element are coupled to each other via a magnetic field and an electric field;

a primary side circuit connected to the first inductance element;

a secondary side circuit connected to the second inductance element; and a circuit that transmits a signal or power between the primary side circuit and the secondary side circuit via the high-frequency transformer.

* * * * *